US008376154B2

(12) United States Patent
Sun

(10) Patent No.: US 8,376,154 B2
(45) Date of Patent: Feb. 19, 2013

(54) MODULAR GRAVITY ACTUATED ROLLING SHELVING ASSEMBLY

(75) Inventor: Yeyang Sun, Westport, CT (US)

(73) Assignee: Sungal Corporation, Westport, CT (US)

( * ) Notice: Subject to any disclaimer, the term of this patent is extended or adjusted under 35 U.S.C. 154(b) by 449 days.

(21) Appl. No.: 12/626,423

(22) Filed: Nov. 25, 2009

(65) Prior Publication Data

US 2010/0133219 A1 Jun. 3, 2010

Related U.S. Application Data

(60) Provisional application No. 61/200,319, filed on Nov. 26, 2008.

(51) Int. Cl.

| | |
|---|---|
| ***A47F 5/08*** | (2006.01) |
| *A47F 3/14* | (2006.01) |
| *A47F 5/00* | (2006.01) |
| *B65G 13/00* | (2006.01) |

(52) U.S. Cl. ..... 211/151; 211/126.15; 211/184; 193/35 R; 193/35 J

(58) Field of Classification Search ..... 211/151, 211/126.15, 189, 59.2, 59.3, 184; 312/91; 108/57.15; 193/35 R, 35 F, 35 J; 414/276
See application file for complete search history.

(56) References Cited

U.S. PATENT DOCUMENTS

| | | | | | |
|---|---|---|---|---|---|
| 842,155 | A | * | 1/1907 | Mathews | 193/35 R |
| 867,350 | A | * | 10/1907 | Dehler | 193/35 J |
| 978,466 | A | * | 12/1910 | Mathews | 193/35 J |
| 2,550,201 | A | * | 4/1951 | Parisi | 193/35 F |
| 2,593,089 | A | * | 4/1952 | Barry | 193/35 R |
| 2,891,677 | A | * | 6/1959 | Ritchie | 211/59.2 |
| 2,964,154 | A | * | 12/1960 | Erickson | 193/35 R |
| 3,103,271 | A | * | 9/1963 | Christiansen, Jr. | 193/35 F |
| 3,746,213 | A | * | 7/1973 | Morrison | 221/303 |
| 3,900,112 | A | * | 8/1975 | Azzi et al. | 211/187 |
| 3,915,275 | A | * | 10/1975 | Specht | 193/35 R |
| 4,168,780 | A | * | 9/1979 | Parrott | 211/151 |
| 4,423,818 | A | * | 1/1984 | Spamer | 211/59.2 |
| 4,681,203 | A | * | 7/1987 | Kornylak | 193/35 R |
| 5,115,920 | A | * | 5/1992 | Tipton et al. | 211/59.2 |
| 5,259,518 | A | * | 11/1993 | Sorenson et al. | 211/59.2 |
| 5,285,909 | A | * | 2/1994 | Slater | 211/151 |
| 5,295,591 | A | * | 3/1994 | Slater | 211/59.2 |
| 5,474,412 | A | * | 12/1995 | Pfeiffer et al. | 414/276 |
| 5,645,155 | A | * | 7/1997 | Houghton | 193/35 R |

(Continued)

FOREIGN PATENT DOCUMENTS

WO WO 2009/097655 8/2009

OTHER PUBLICATIONS

International Preliminary Report on Patentability (IPRP) dated Apr. 13, 2012 for PCT application PCT/US2009/065975.

*Primary Examiner* — Joshua J Michener
*Assistant Examiner* — Devin Barnett
(74) *Attorney, Agent, or Firm* — Ohlandt, Greeley, Ruggiero & Perle, LLP

(57) ABSTRACT

A shelving assembly comprises a unit that comprises a base plate having a first side and a second side opposite the first side. The base plate has an integral one-piece configuration including a plurality of strengthening or reinforcing vertical and/or horizontal ribs disposed on the second side. A plurality of securing members are disposed in a parallel relationship on the first side. Each of the plurality of securing members has a plurality of snap fit openings. A plurality of rollers that each comprises a centrally disposed cylindrical portion and a pair of connection rods extending from opposite ends of the cylindrical portion. The connection rods are removably and fixedly insertable into a pair of oppositely disposed snap fit openings of adjacent securing members, thereby forming a row of rollers disposed on the base plate.

32 Claims, 47 Drawing Sheets

U.S. PATENT DOCUMENTS

| | | | | |
|---|---|---|---|---|
| 5,788,090 | A * | 8/1998 | Kajiwara | 211/59.2 |
| 5,951,228 | A * | 9/1999 | Pfeiffer et al. | 414/276 |
| 6,007,248 | A * | 12/1999 | Fulterer | 384/53 |
| 6,089,385 | A * | 7/2000 | Nozawa | 211/59.2 |
| 6,102,185 | A * | 8/2000 | Neuwirth et al. | 193/35 R |
| 6,132,158 | A * | 10/2000 | Pfeiffer et al. | 414/276 |
| 6,186,725 | B1 * | 2/2001 | Konstant | 414/276 |
| 6,409,026 | B2 * | 6/2002 | Watanabe | 211/59.2 |
| 6,431,808 | B1 * | 8/2002 | Lowrey et al. | 414/276 |
| 6,497,326 | B1 * | 12/2002 | Osawa | 211/59.2 |
| 6,823,997 | B2 * | 11/2004 | Linden et al. | 211/59.3 |
| 6,843,632 | B1 * | 1/2005 | Hollander | 414/276 |
| 7,028,852 | B2 * | 4/2006 | Johnson et al. | 211/59.3 |
| 7,114,606 | B2 * | 10/2006 | Shaw et al. | 193/35 R |
| 7,168,546 | B2 * | 1/2007 | Plesh, Sr. | 193/35 R |
| 7,398,876 | B2 * | 7/2008 | Vestergaard | 198/812 |
| 7,530,452 | B2 * | 5/2009 | Vestergaard | 198/831 |
| 7,815,060 | B2 * | 10/2010 | Iellimo | 211/151 |
| 7,918,353 | B1 * | 4/2011 | Luberto | 211/59.3 |
| 8,025,162 | B2 * | 9/2011 | Hardy | 211/59.3 |
| 2001/0017284 | A1 * | 8/2001 | Watanabe | 211/59.2 |
| 2004/0011754 | A1 * | 1/2004 | Zadak | 211/184 |
| 2004/0178156 | A1 * | 9/2004 | Knorring et al. | 211/59.2 |
| 2004/0247422 | A1 * | 12/2004 | Neumann et al. | 414/529 |
| 2005/0072657 | A1 * | 4/2005 | Lawless et al. | 198/782 |
| 2005/0150847 | A1 * | 7/2005 | Hawkinson | 211/59.2 |
| 2006/0186066 | A1 | 8/2006 | Johnson | |
| 2007/0256992 | A1 | 11/2007 | Olson | |
| 2008/0250986 | A1 * | 10/2008 | Boon | 108/53.1 |
| 2010/0072152 | A1 * | 3/2010 | Kim | 211/151 |
| 2010/0078402 | A1 * | 4/2010 | Davis et al. | 211/184 |
| 2010/0133214 | A1 * | 6/2010 | Evans | 211/85.8 |
| 2010/0206829 | A1 * | 8/2010 | Clements et al. | 211/162 |
| 2010/0276383 | A1 * | 11/2010 | Hardy | 211/59.3 |

* cited by examiner

MODULAR GRAVITY ACTUATED ROLLING SHELVING ASSEMBLY

CROSS REFERENCE TO RELATED APPLICATIONS

This application claims the benefit of U.S. Provisional Application No. 61/200,319 filed on Nov. 26, 2008.

BACKGROUND

1. Field of the Disclosure

The present disclosure relates generally to shelves having a mechanism for moving an item thereon via gravity. More particularly, the present disclosure relates to a shelf that may be inclined and has rollers to move an item thereon.

2. Description of Related Art

Items, such as, medicines packaged in boxes or bottles, may be displayed in rows on a shelf so that when one of the items is removed, another of the items remains displayed. One such configuration is a spring-pusher system that includes a spring-loaded pusher member. When an item within a row is removed, the spring-loaded pusher member urges another item to a position of the removed item. The spring-loaded pusher member undesirably takes up space within the shelf so that the items must be replenished more often than without the presence of the spring-loaded pusher member. In addition, the force of the spring-loaded pusher member on the items makes it difficult to remove the items.

Another type of shelving system utilizes a gravity actuated roller pin system. Undesirably, such shelving systems are made from numerous parts, e.g., 18 to 24 parts, that must be assembled, thereby increasing labor and cost. These displays typically include separate roller tracks having individual metal backing supports that undesirably bend and/or twist due to their individual roller track design. The bending and/or twisting can cause undesirably items to fall off of the display.

Additionally, such conventional gravity roller shelving systems have rollers loosely disposed on a base portion, each roller in its own holding chamber or cut-out, wherein a retainer strip is placed over all of the rollers in a strip in order to secure them to the base portion. Thus, if one roller needs to be removed, the retainer strip has to be removed, which frees all of the rollers from the base portion allowing other rollers to accidentally dislodge from the base. Moreover, the retainer strip placed over the rollers is attached to the assembly via screws, and should one of the screws become loose all of the rollers can become misaligned inhibiting or preventing rollers from rotating.

Accordingly, there is a need for a shelving system that moves items without a spring-loaded pusher member. There is a further need for a shelf that reduces the amount of parts that needs to be assembled. There is a further need for a shelf that connects each of a plurality of rollers separately to a base plate, thereby avoiding misalignment or failure to perform the rollers intended function.

SUMMARY

A shelving assembly comprising at least one unit that comprises: a base plate; a plurality of securing members disposed in a parallel relationship on the base plate, wherein each the securing member includes a plurality of snap fit openings; and a plurality of rollers that each comprise a centrally disposed cylindrical portion and a pair of connection rods extending from opposite ends of the cylindrical portion, wherein each the roller is securely disposed within a pair of oppositely disposed snap fit openings disposed on adjacent securing members, wherein the secured rollers are capable of radial rotation within the openings.

The base plate further comprises first and second edges disposed substantially perpendicular to the securing members, wherein the first and second edges each comprises a plurality of divider slots.

The shelving assembly further comprising at least one divider, wherein the divider comprises a pair of protrusions that are removably insertable into oppositely disposed divider slots, one from each of the first and second edges, and such that the divider is disposed substantially parallel to the securing members.

The securing member includes at least one fastener, wherein the fastener affixes the securing member to the base plate. Preferably, the fastener is at least one selected from the group consisting of: screws, pins, clips, adhesives, rivets and the like.

The snap fit openings comprise adjacent arm portions, each the arm portion having a first end integrally formed together with a base portion of the securing member and a second end having a at least one projecting perturbation portion, wherein each perturbation portion of one arm portion is disposed opposite the perturbation portion of an adjacent arm portion, wherein the connection rod of the roller is disposed within the snap fit opening such that it rotates within the opening, while also prohibiting its removal from the opening without the application of a force sufficient to urge the perturbation portions of the oppositely disposed arm portions apart such that the connection rod passes through the perturbation portion of each arm portion.

The shelving assembly further comprising a plurality of units connected in parallel relationship to one another.

Preferably, each unit further comprises a first channel member disposed about the first edge portion and/or a second channel member disposed about the second edge portion, wherein a first retainer plate is removably disposed within the first channel member substantially perpendicular to the securing members and/or a second retainer plate is removably disposed within the second channel member substantially perpendicular to the securing members.

The shelving unit further comprises a first channel member attached to the first edge portion of the base plate and a second channel member attached to the second edge portion of the base plate. The first and second channel members further comprise a base channel, and the base channel has a ridge to secure to a recess of the first and second edge portions of the base plate.

The first and second channel members further comprise a retainer channel, and the first retainer is removably disposed within the retainer channel of said first channel member substantially perpendicular to the securing members and/or a second retainer is removably disposed within the retainer channel of the second channel member substantially perpendicular to the securing members.

The shelving assembly further comprising a mass-pusher assembly having a mass and a securing tether, and, optionally, at least one hook, wherein said tether connects the weight to the unit, whereby the mass is disposed on the rollers to ensure that products disposed on the rollers remain in contact with the first retainer as products are removed therefrom. Optionally, the securing tether can be secured to the unit via a fastener (e.g., a hook) which is attached to both the end of the tether opposite of the mass and the unit, e.g., the fastener is attached to the mass. Preferably, the tether is secured to the second retainer mass-pusher via an opening therein.

The shelving assembly further comprising a pair of support panels disposed on opposite sides of the unit, each support panel includes a first tab and a second tab disposed about each end. First and second tabs are removably disposed within the tab channels to attach to the support panel.

Preferably, the base plate has a length of between about 2 inches to about 48 inches and a width between about 8 inches to about 36 inches.

The above-described and other advantages and features of the present disclosure will be appreciated and understood by those skilled in the art from the following detailed description, drawings, and appended claims.

DETAILED DESCRIPTION OF THE INVENTION

Figure 1:
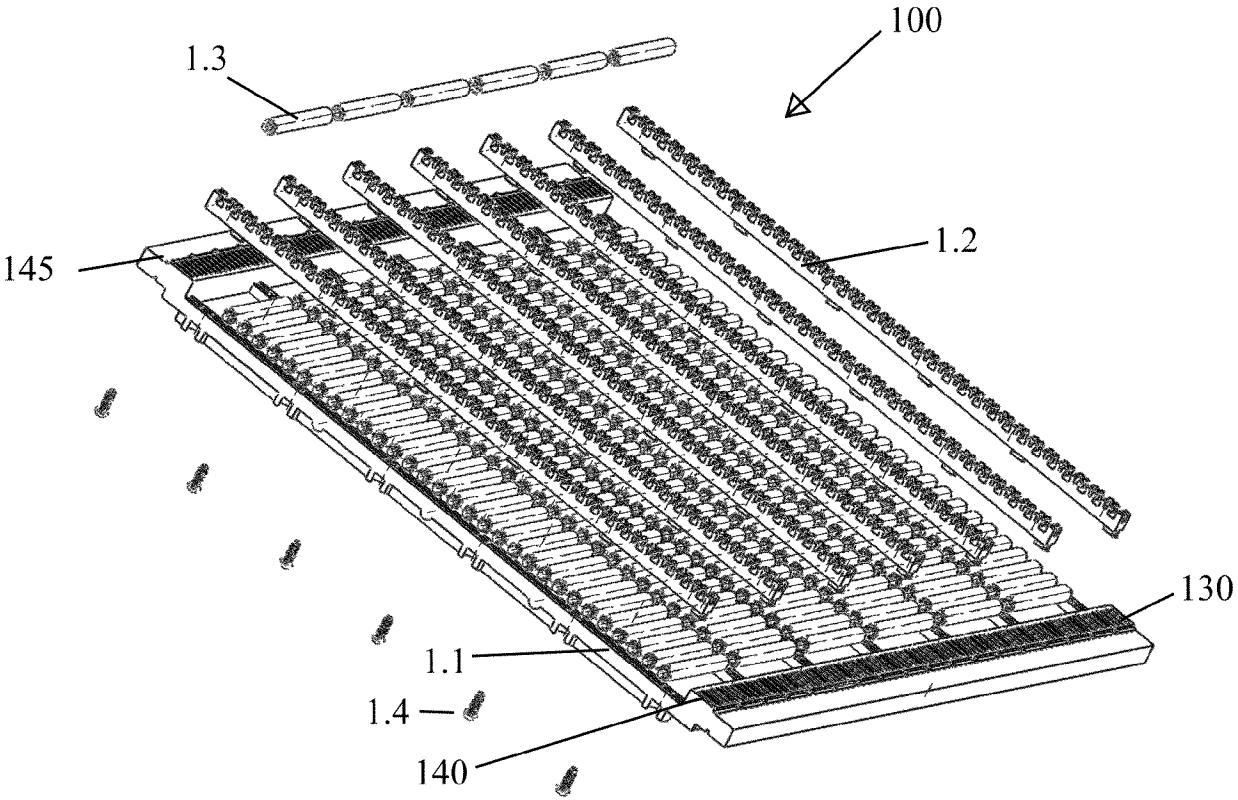
FIG. 1 is a front exploded perspective view of a unit of a shelving assembly of the present disclosure.

Referring to the drawings, and, in particular to FIGS. 1-6, an exemplary embodiment of a unit of a shelving assembly according to the present disclosure is shown that is generally referred to by reference numeral 100.

FIG. 1 is a front exploded perspective view of unit 100. Unit 100 has a base plate 1.1, a plurality of securing members 1.2, a plurality of rollers 1.3, and one or more fastener 1.4.

Figure 2:
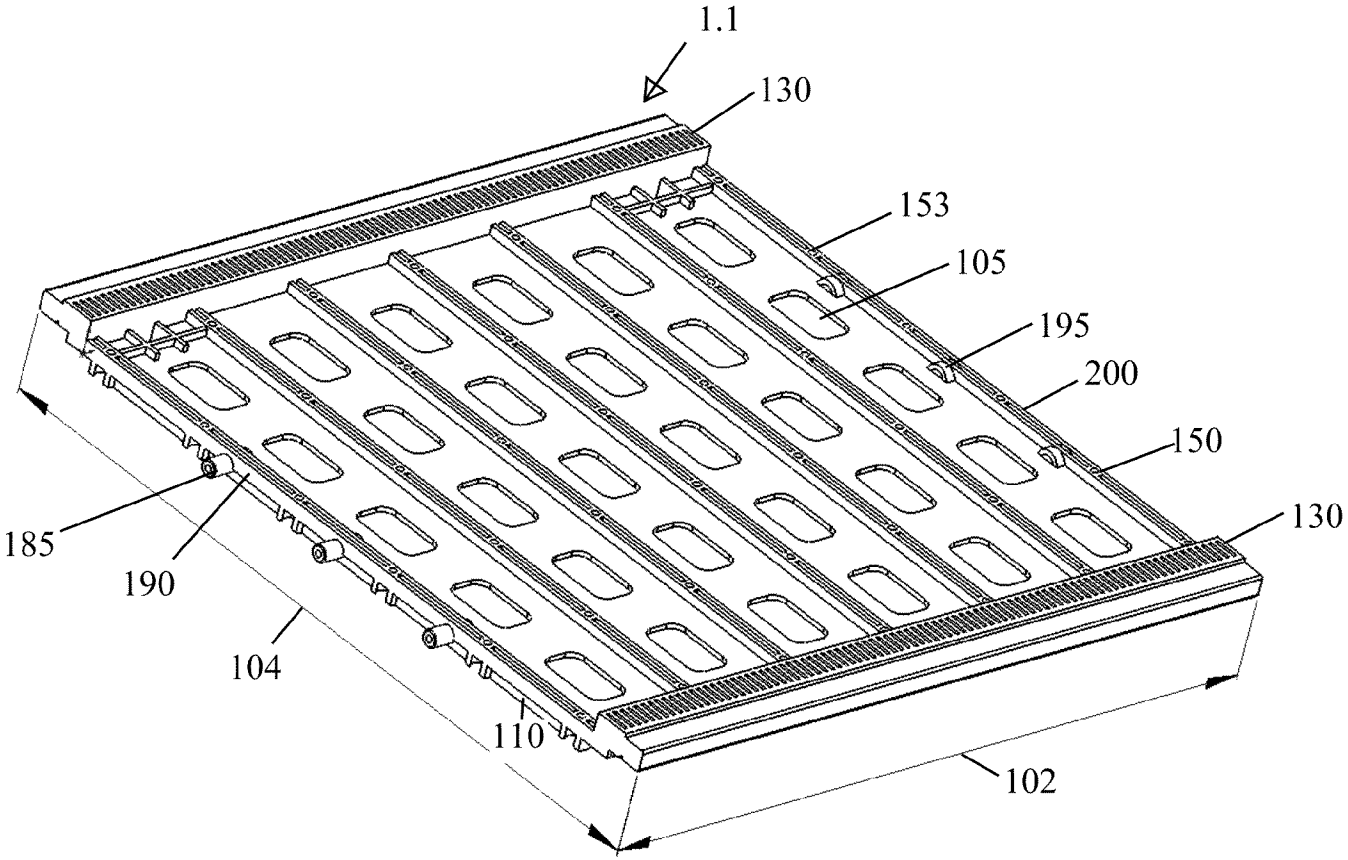
FIG. 2 is a front perspective view of a base plate of the present disclosure.

FIG. 2 is a front perspective view of base plate 1.1. Base plate 1.1 is one integral one-piece configuration. Base plate 1.1 may be molded plastic, such as, for example, acrylonitrile butadiene styrene ABS. The plastic, such as, for example, is injection molded plastic. Base plate 1.1 may be made of an opaque, semi-opaque or clear material allowing light to come through. Base plate 1.1 may have a length 102 that may be about 304.38 millimeters (mm), about 2 inches, about 6 inches, about 12 inches, about 24 inches, about 36 inches, about 48 inches, or about 2 inches to about 48 inches and a width 104 that is about 325.50 mm, about 340.00 mm, about 2 inches, about 4 inches, about 6 inches, about 8 inches, about 10 inches, about 12 inches, about 14 inches, about 16 inches, about 18 inches, about 20 inches, about 22 inches, about 24 inches, about 26 inches, about 28 inches, about 30 inches, or from about 10 inches to about 30 inches. For example, 14 inches×48 inches for vitamins and 22 inches×24 inches for big soda bottles; however, base plate may be any length or width.

Base plate 1.1 has a plurality of apertures 105. Plurality of apertures 105 are integrally formed within base plate 1.1. Plurality of apertures 105 may be formed during molding of base plate 1.1. Plurality of apertures 105 reduces and minimizes a material forming base plate 1.1. Reducing and minimizing the material forming base plate 1.1 reduces the cost of manufacturing base plate 1.1. Plurality of apertures 105 also reduces and minimizes a weight of base plate 1.1. Reducing the weight of base plate 1.1 advantageously increases ease of transporting and installing the shelving assembly that includes base unit 100.

Figure 13:
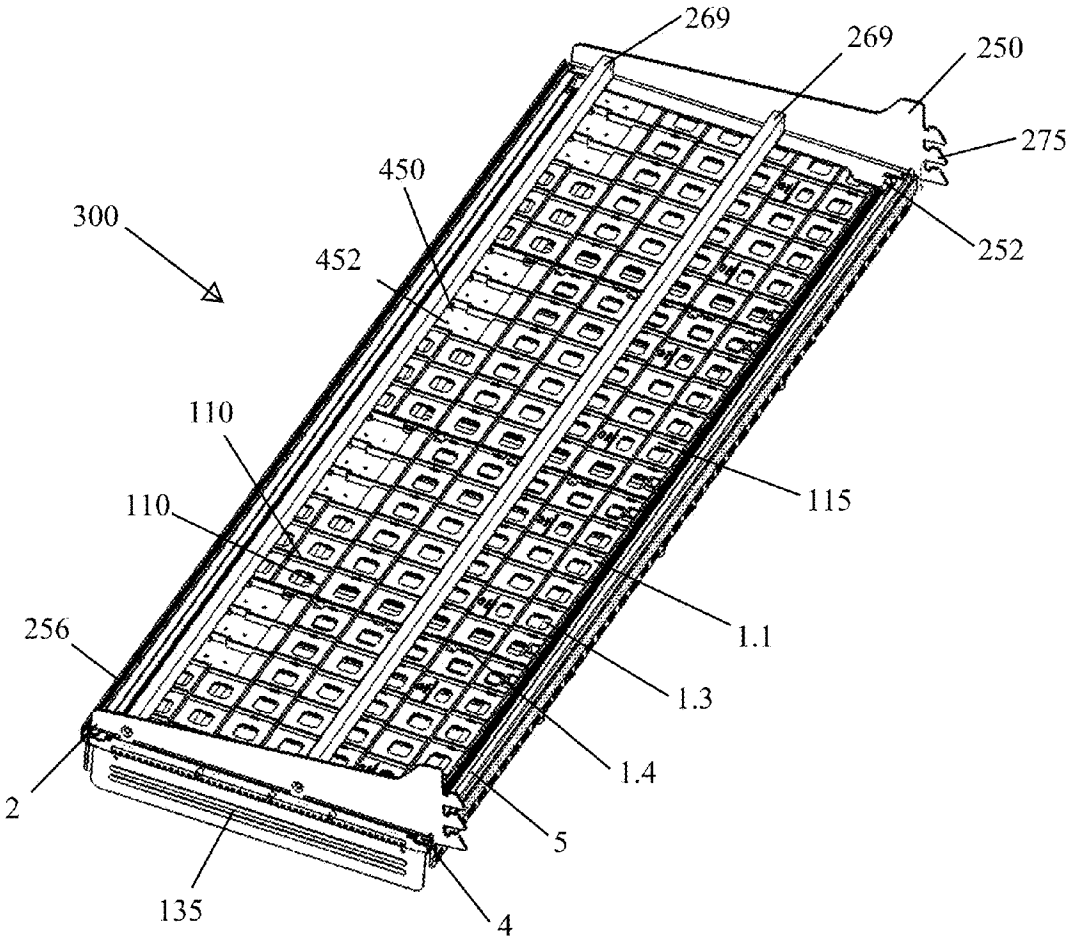
FIG. 13 is a bottom perspective view of a shelving assembly of the present disclosure.
Figure 14:
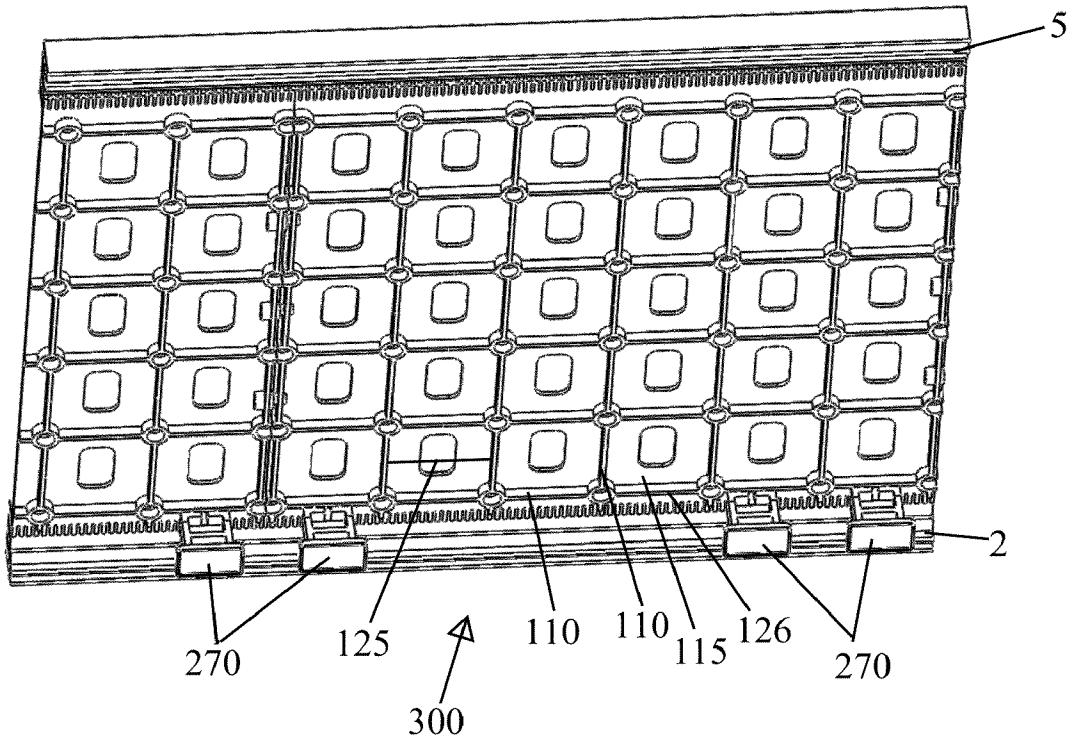
FIG. 14 is a bottom perspective view of a shelving assembly of the present disclosure.

Base plate 1.1 has one or more ribs 110 (shown in FIGS. 2 and 13-15) integrally formed therewith. Ribs 110 may be formed during molding of base plate 1.1. Ribs 110 are on a second or bottom side 115 of base plate 1.1. Ribs 110 protrude outward from bottom side 115. As shown in FIG. 14, ribs 110 have a height 120, a width 125, and a thickness 128 (shown in FIG. 15). Ribs 110 may be, for example, about +5% to about 10% of the thickness of base plate 1.1. Height 120 may be, such as, for example, 0.75 inches. It has been discovered by the inventor of the present application that ribs 110 support and strengthen base plate 1.1. Advantageously, ribs 110 allow base plate 1.1 to have a reduced thickness while providing structural integrity, such as, for example, a reduced thickness of about 10%. Base plate 1.1 has a thickness so that along with ribs 110, base plate can support items placed thereon. In contrast, prior art displays typically include individual metal backing supports that undesirably bend and/or twist. The bending and/or twisting can cause undesirably items to fall off of the display.

As shown in FIGS. 1, 2, 5, and 6, base plate 1.1 includes one or more slots 130 integrally formed therewith. Slots 130 may be formed during molding of base plate 1.1. Slots 130 may be formed in a first edge portion 140 and a second edge portion 145 opposite first end portion 140 of base plate 1.1. Advantageously, molding slots 130 into base plate 1.1 reduces the number of parts that need to be connected and assembled to base plate 1.1.

Figure 5:
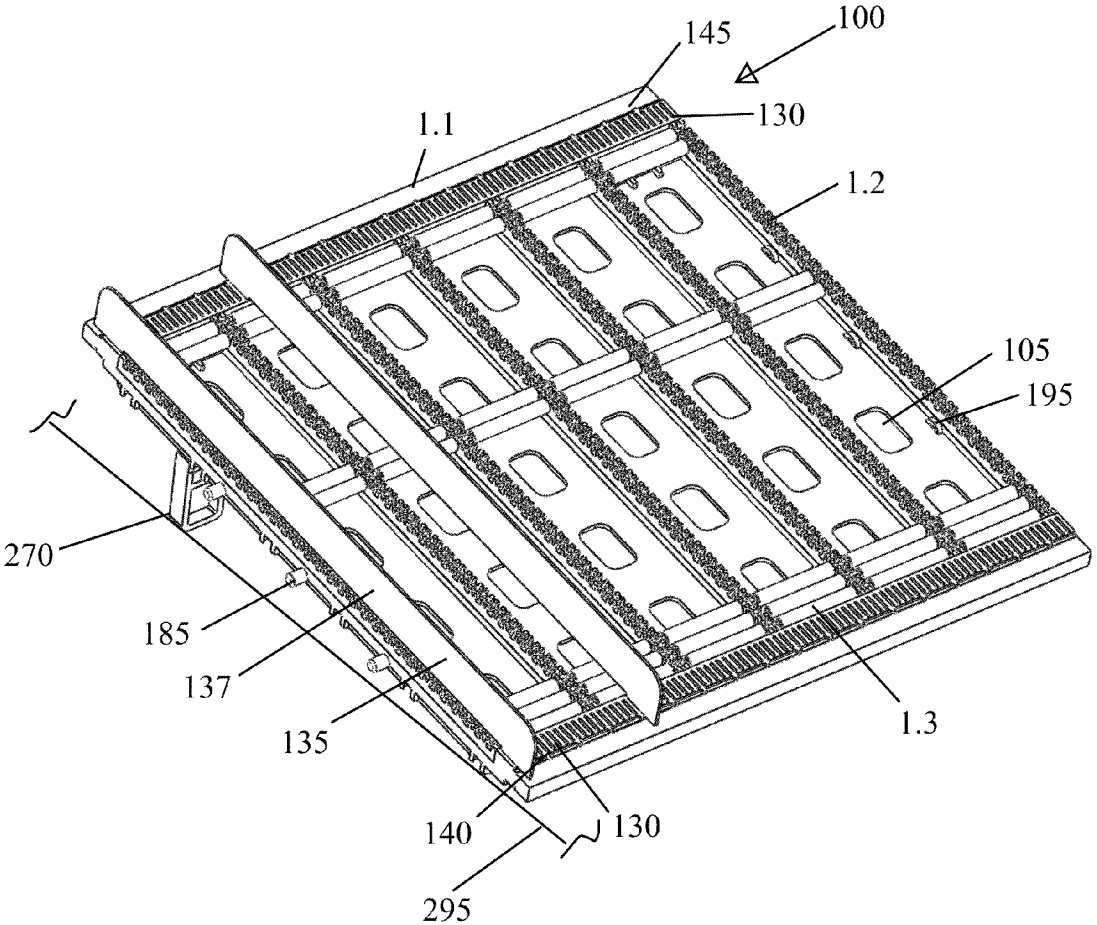
FIG. 5 is a front perspective view of a unit of a shelving assembly of the present disclosure.
Figure 6:
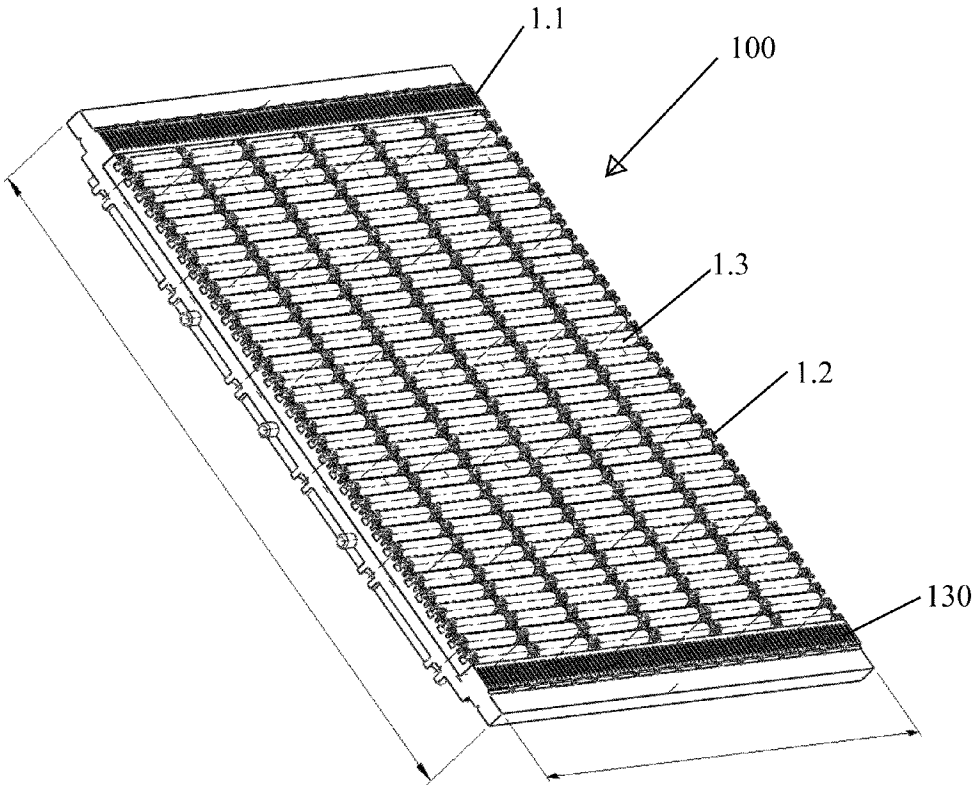
FIG. 6 is a front perspective view of a unit of a shelving assembly of the present disclosure.
Figure 7:
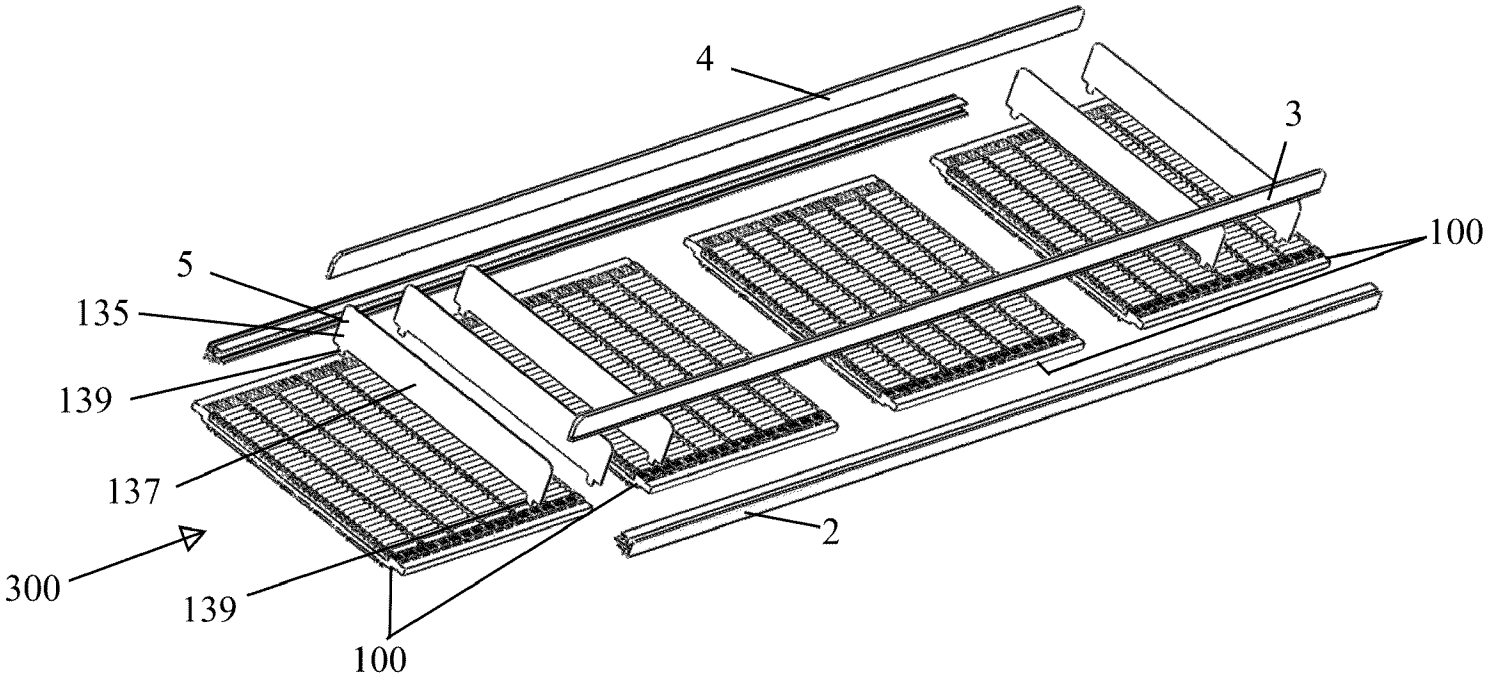
FIG. 7 is a front perspective exploded view of a shelving assembly of the present disclosure.
Figure 17:
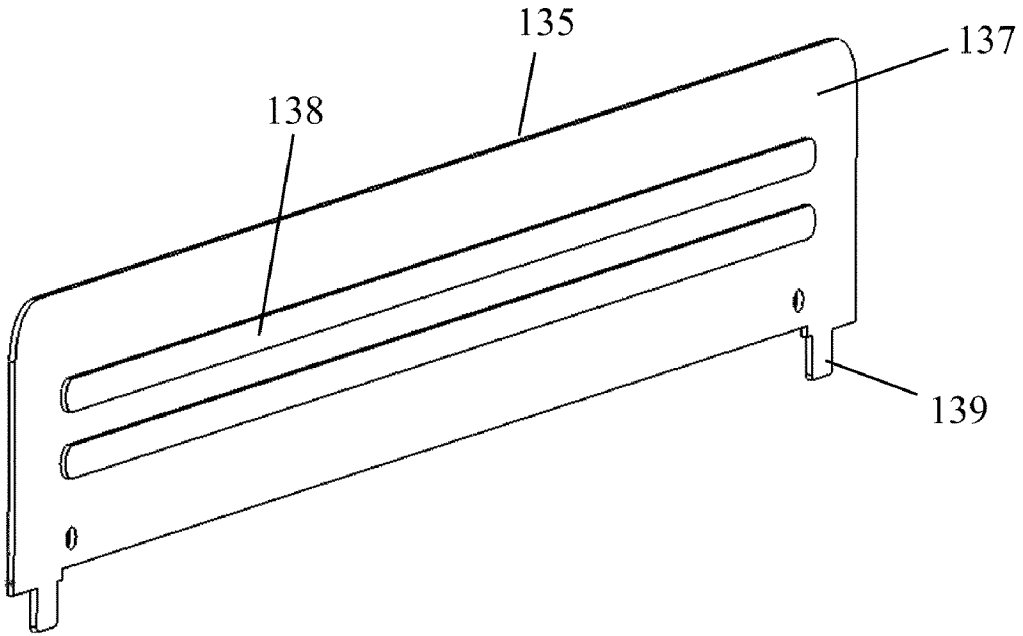
FIG. 17 is a front perspective view of a divider having ribs of the present disclosure.

As shown in FIGS. 5 and 7, a divider 135 is connectable to base plate 1.1 by slots 130. Divider 135 has a planer divider portion 137 and one or more protrusions 139 that protrude from divider portion 137. As shown in FIG. 17, divider 135 may have ribs 138 on planer divider portion 137. Ribs 138 provide added strength and stability to divider 135. Protrusions 139 removably connect to slots 130. Protrusions 139 connect to slots 130, for example, by inserting one of protrusions 139 into one of slots 130 by friction fit. More than one of slots 130 allows divider 135 to be positioned at different locations on base plate 1.1. Divider 135 may be moved to another location on base plate 1.1 to accommodate different sized items placed on unit 100 of the shelving assembly. More than one divider 135 may be connected to base plate 1.1 so that one or more items fit between the dividers to direct the position and/or movement of the item on the shelving assembly. Dividers 135 may be adjustable to increase or decrease in length. This allows a single divider 135 to be used with various sized base plates 1.1.

Figure 15:
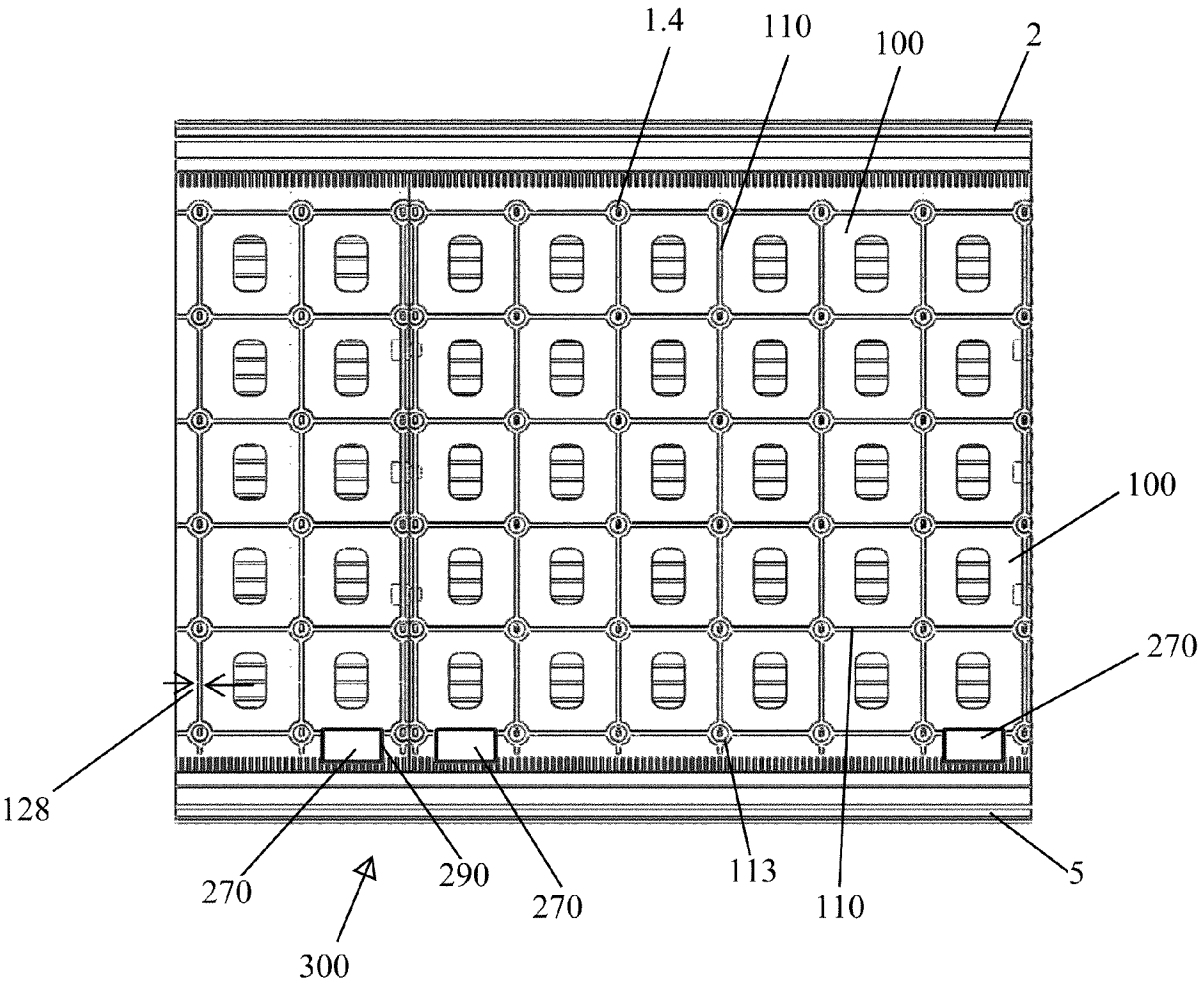
FIG. 15 is a bottom perspective view of a shelving assembly of the present disclosure.

As shown in FIG. 2, base plate 1.1 has receiving portions 150 integrally formed therewith. Receiving portions 150 may be formed during molding of base plate 1.1. Receiving portions 150 receive securing member 1.2 thereon. Receiving portions 150 may have one or more holes 153. Securing member 1.2 may have one or more holes that fit over holes 153 of receiving portion 150 so that securing member 1.2 may be connected to one of receiving portions 150 by fastener 1.4 that fit through holes 153 and the holes in securing member 1.2. Fastener 1.4 are, such as, for example, screws, or plastic pins that are one part of the integral base plate to lock securing member 1.2 instead of screws. As shown in FIG. 15, ribs 110 may have a circular portion 113 that surrounds holes 153. It is contemplated by the present disclosure that securing member 1.2 may be connected to base plate 1.1 by other connection devices, such as, for example, adhesive. Securing member 1.2 is connected to base plate 1.1 adjacent another securing member 1.2 disposed in a parallel relationship to connect a plurality of rollers 1.3 therebetween. Plurality of rollers 1.3 may be formed in adjacent rows, each row being between two of securing members 1.2.

Figure 3:
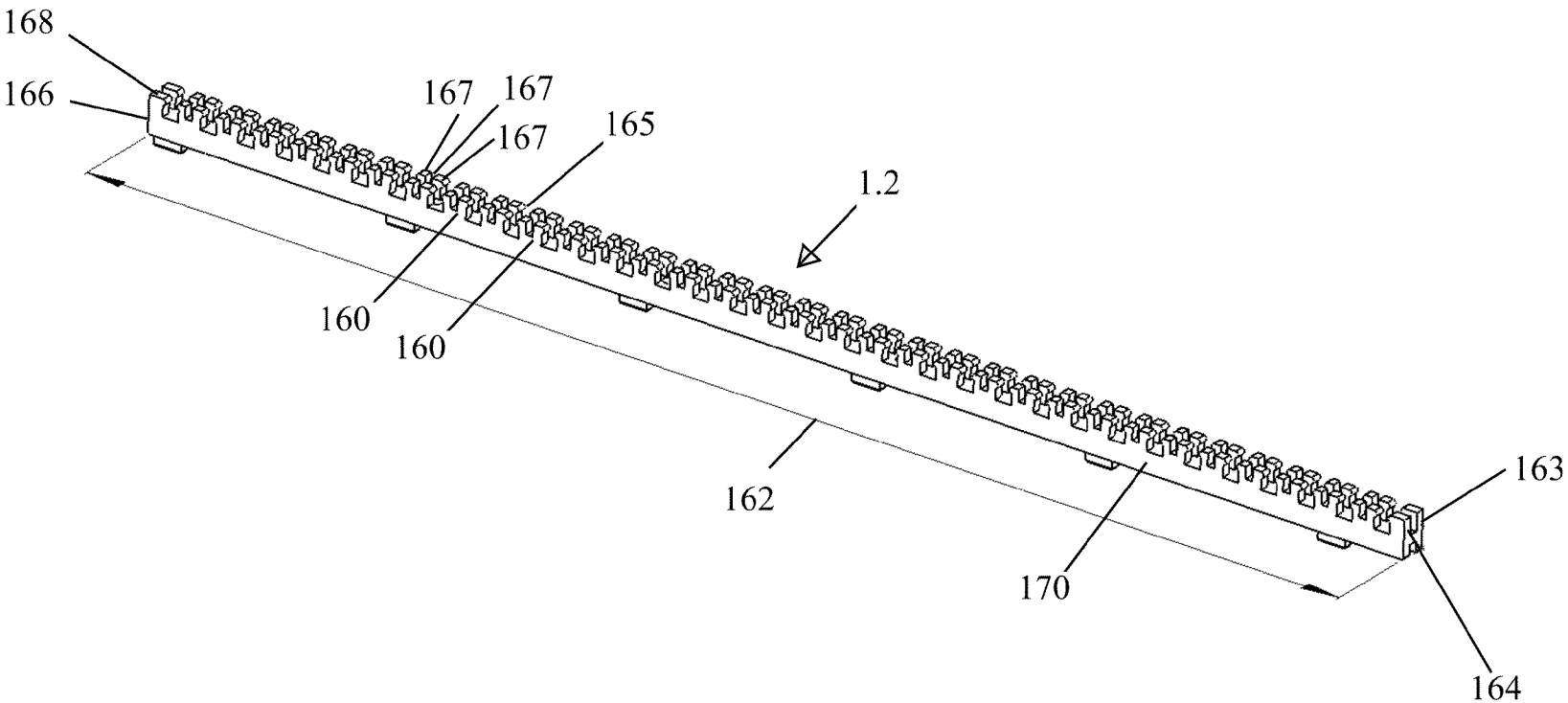
FIG. 3 is a front perspective view of a securing member of the present disclosure.

As shown in FIG. 3, securing member 1.2 has a plurality of arm portions 160 along a length of a base portion 170. Securing member 1.2 may have a first row 163 of arm portions 160 on a first side of securing member 1.2 and a second row 164 of arm portions 160 on a second side of securing member 1.2 to connect plurality of rollers 1.3 between adjacent securing members 1.2. Each pair of adjacent arm portions 160 forms an opening 165 therebetween. Each arm portion 160 may be connected to securing member 1.2 at a first end 166 that is integrally formed together with base portion 170, and have at least one perturbation portion 167 at a second end 168.

Figure 4:
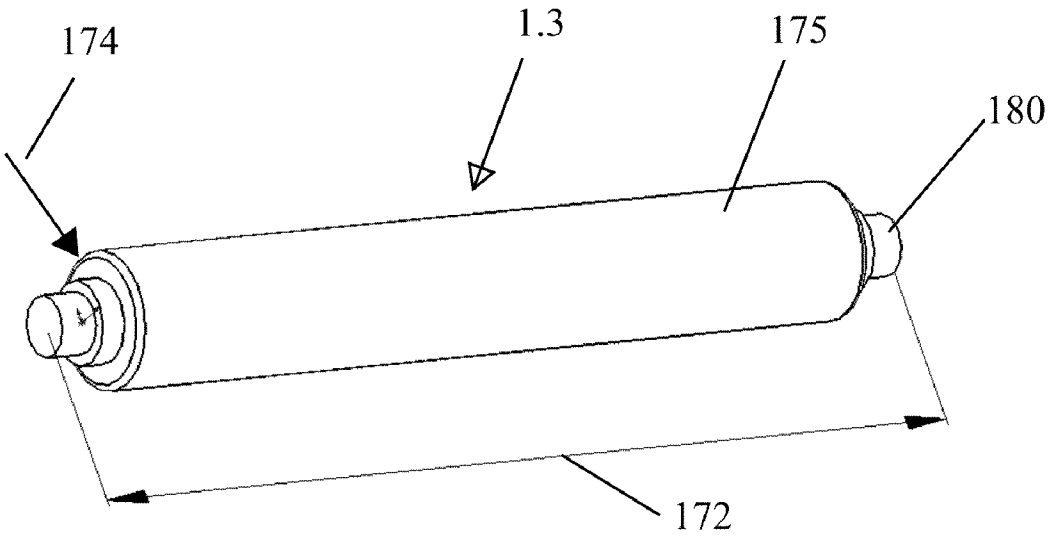
FIG. 4 is a front perspective view of a roller of the present disclosure.

As shown in FIG. 4, each roller 1.3 has a cylinder portion 175 and a connection rod 180 on opposite sides of cylinder portion 175. Rollers 1.3 can be made of a material that is clear, opaque or semi-opaque in appearance, thereby allowing lighting or other visual effects to be applied to the shelves. Cylinder portion 175 is cylindrical. Roller 1.3 is straight, cylindrical and smooth. Connection rods 180 are removably inserted into openings 165 between a pair of adjacent arm portions 160 to fixedly secure rollers 1.3 to base plate 1.1. Connection rods 180 have a size to fit within openings 165. Connection rods 180 may be "snap" fit or removably inserted into openings 165 so that connection rod 180 is connected to arm portions 160 by friction fit. Each of rollers 1.3 can rotate while connected within adjacent arm portions 160.

Figure 12:
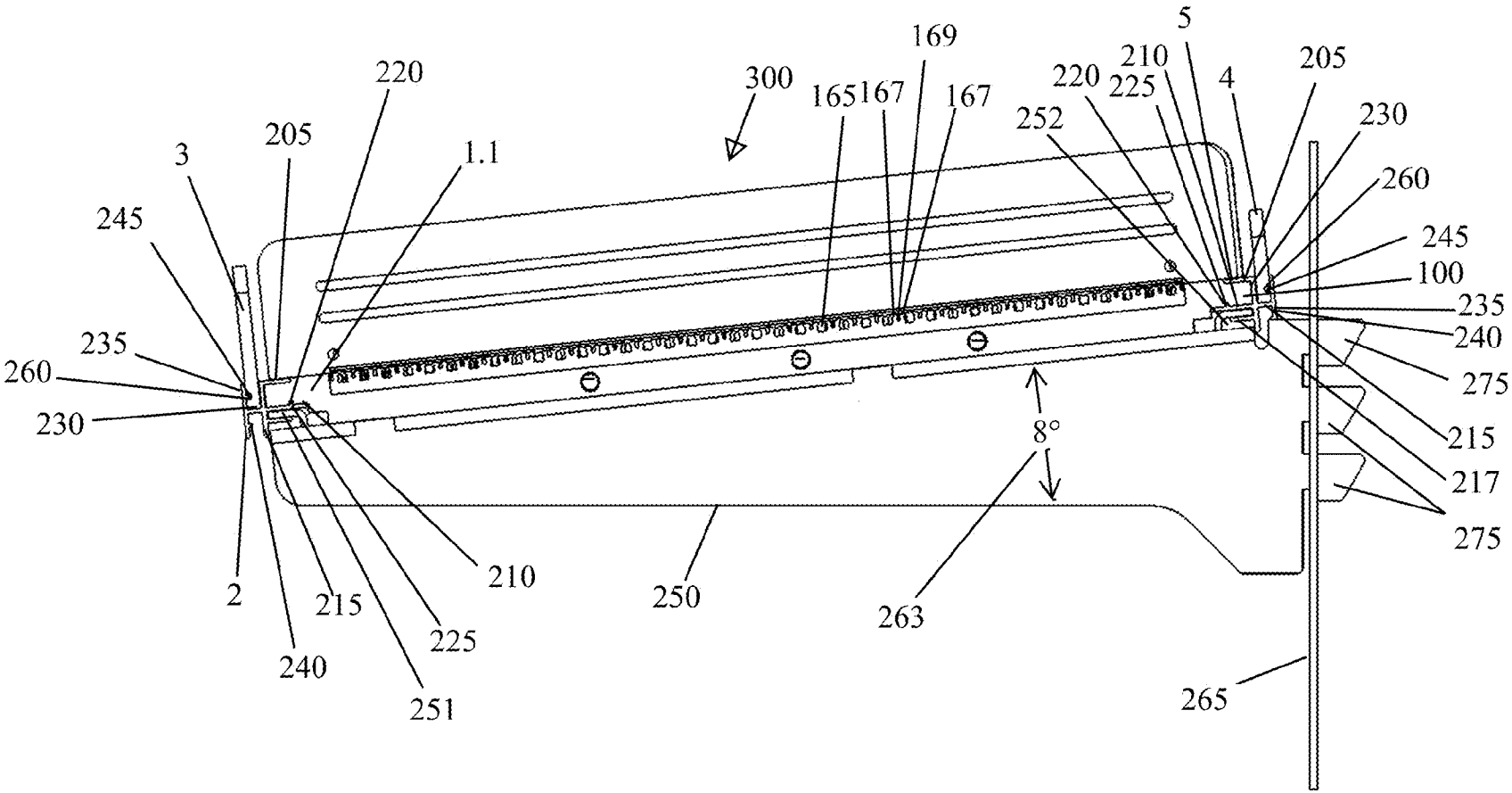
FIG. 12 is a side view of a shelving assembly of the present disclosure.

As shown in FIGS. 3 and 12, arm portion 160 may have a space 169 on arm portion 160 creating a separated pair of perturbation portions 167. Space 169 between the separated pair of perturbation portions 167 aids in inserting or removing rollers 1.3 into openings 165. The perturbation portions 167 of adjacent arm portions 160 are urged apart when connection rods 180 are inserted into openings 165 or removed from openings 165 of securing member 1.2. Once rollers 1.3 are inserted into openings 165, perturbation portions 167 may be placed above connection rods 180 to secure rollers 1.3 to securing member 1.2. Arm portions 160 are spaced apart from an adjacent arm portions 160 so that the area between each of rollers 1.3 is minimized while allowing each of plurality of rollers 1.3 to rotate. Securing member 1.2 may be any length 162, such as, for example, about 274.90 millimeters. Rollers 1.3 may be any length 172 and have any sized diameter 174, such as, for example, roller 1.3 may have a length that is about 47.00 millimeters and a diameter that is about 6.5 millimeters.

It has been discovered by the inventor of the present application that securing members 1.2 allow insertion or removal of each of plurality of rollers 1.3 without disconnecting another of plurality of rollers 1.3 from base plate 1.1. Advantageously, should one of plurality of rollers 1.3 need to be inserted or removed due to, for example, assembly or replacement due to damage, a force may be applied to roller 1.3 to pull it away from securing member 1.2 to remove the roller 1.3 from base plate 1.1 or to push roller 1.3 into opening 165 between adjacent arm portions 160 toward securing member 1.2 to fixedly secure roller 1.3 to base plate 1.1 while all remaining rollers maintain attachment to base plate 1.1.

As shown in FIG. 2, base plate 1.1 has a protruding connector 185 on a first side edge 190 and a receiving recess 195 on a second side edge 200 opposite first side edge 190 integrally formed therewith. Protruding connector 185 and receiving recess 195 may be formed during molding of base plate 1.1. Protruding connector 185 can be inserted into receiving recesses on another base plate to increase the size of the shelving assembly. Protruding connector 185 may connect to receiving recesses, for example, by friction fit.

Figure 8:
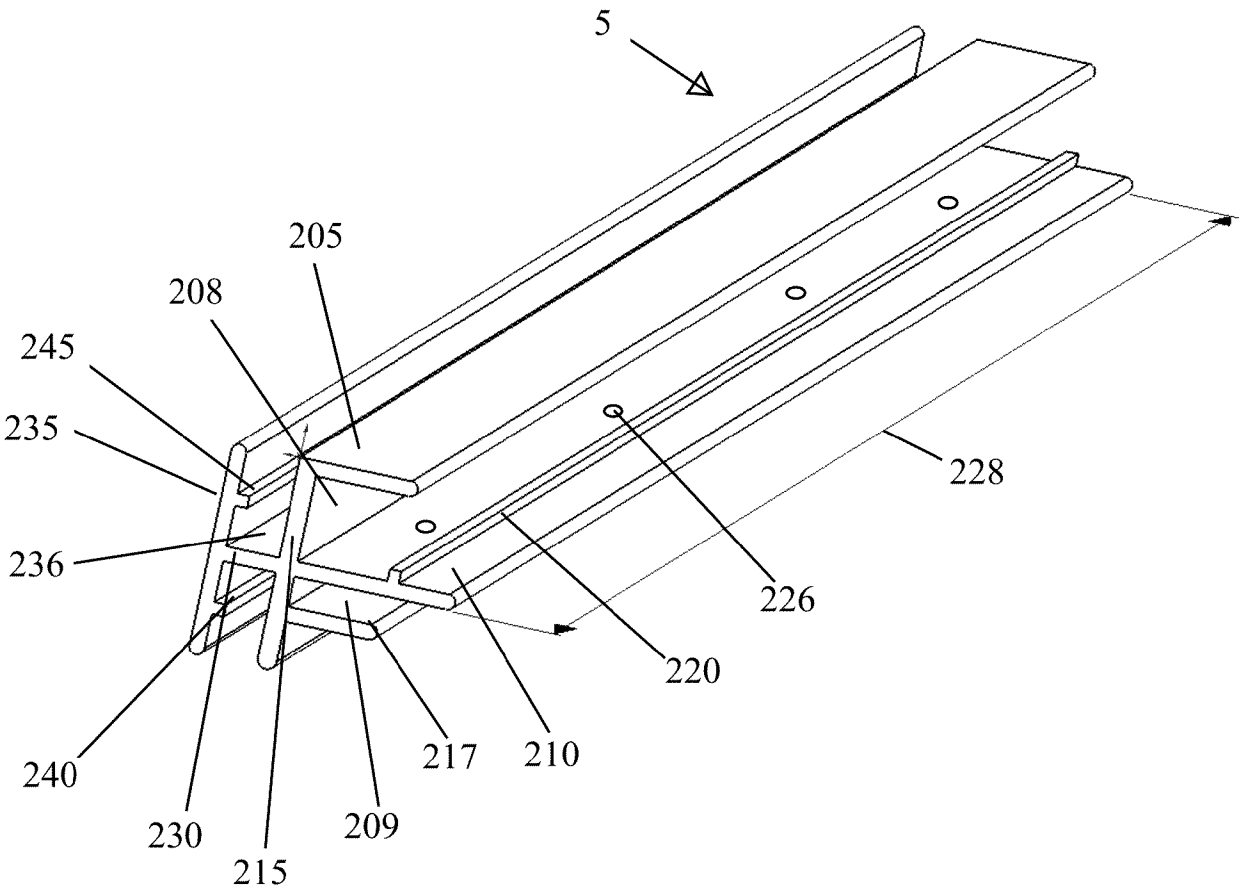
FIG. 8 is a front perspective view of a first channel member and/or a second channel member of the present disclosure.

As shown in FIG. 5, unit 100 may be used as part of a shelving assembly 300, or, as shown in FIGS. 7-16, one or more units 100 may be connected to form shelving assembly 300. For example, four units may be connected to form a 48 inch shelving assembly. Units 100 may be attached to a first channel member 2 and a second channel member 5. FIG. 8 is a front perspective view of second channel member 5. Second channel member 5 has a top projection 205, a middle projection 210, and a bottom projection 217 that extend from a member 215. As shown in FIG. 8, a base channel 208 is formed between top projection 205 and middle projection 210, and a tab channel 209 is formed between middle projection 210 and bottom projection 217.

Figure 16:
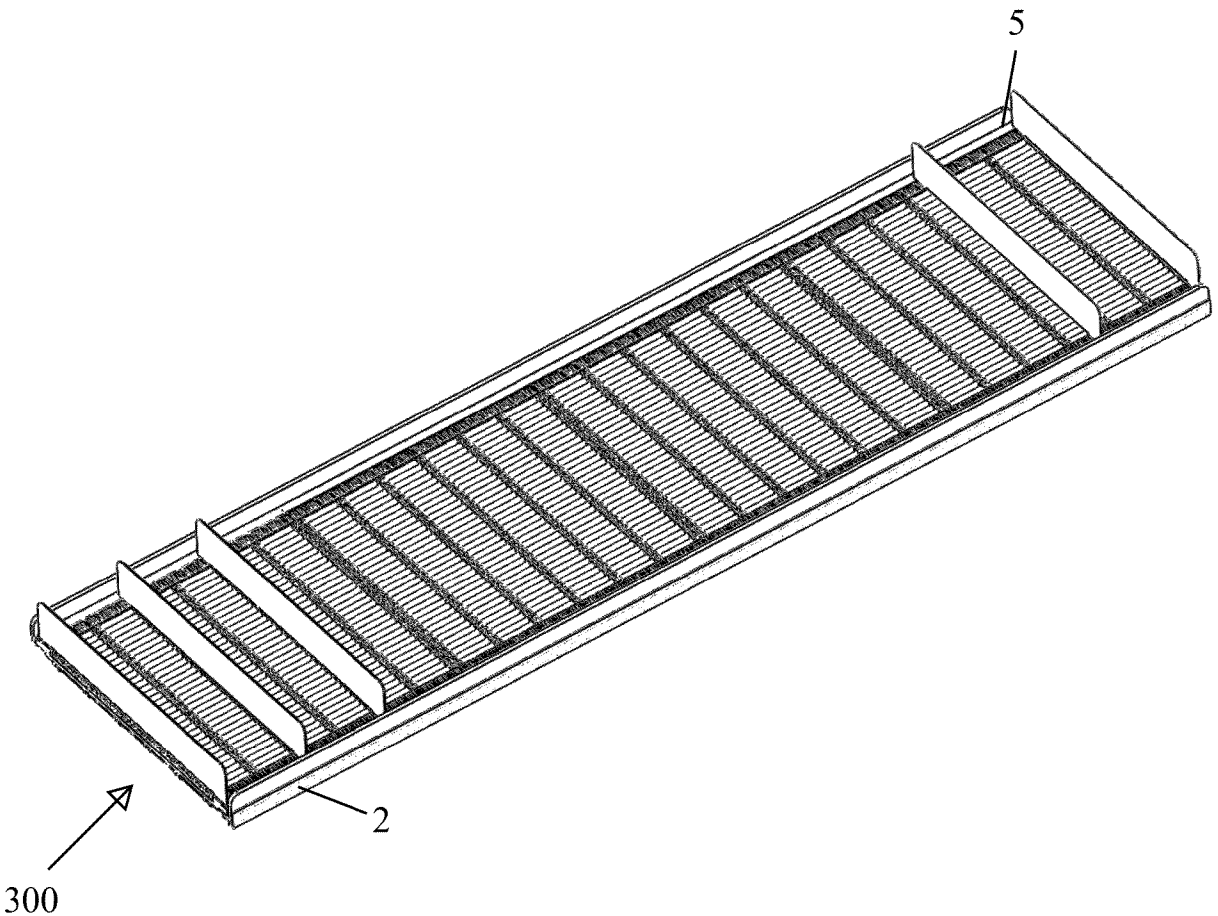
FIG. 16 is a front perspective view of a shelving assembly of the present disclosure.

As shown in FIGS. 12 and 16, base plate 1.1 is disposed within base channel 208 of second channel member 5 to connect base units 100. As shown in FIG. 12, top projection 205 is positioned on top of base plate 1.1, middle projection 210 is positioned below base plate 1.1, and member 215 is positioned adjacent base plate 1.1. Middle projection 210 may have a ridge 220. Base plate 1.1 may have a recess 225 complementary in shape to ridge 220 so that ridge 220 fits within recess 225 when second channel member 5 is connected to base plate 1.1. Second channel member 5 may be connected to base plate 1.1, such as, for example, by friction fit. Second channel member 5 may have one or more apertures 226 (shown in FIG. 8) that are positioned with corresponding holes on base plate 1.1 to connect second channel member 5 to base plate 1.1 by nails or screws.

Unit 100 may have a support panel 250 connected on opposite sides of the unit 100. Support panel 250 is connected to the unit by a first tab 251 and a second tab 252 shown in FIG. 12. As shown in FIG. 12, second tab 252 is disposed within tab channel 209 (FIG. 8) of second channel member 5 to connect support panel 250. As shown in FIG. 12, middle projection 210 may be positioned above second tab 252, bottom projection 217 may be positioned below second tab 252, and member 215 may be adjacent second tab 252 to connect support panel 250 to second channel member 5. Support panel 250 removably connects shelving assembly 300 to a wall or shelving unit. Support panel 250 is made of a sturdy material, such as steel.

Figure 9:
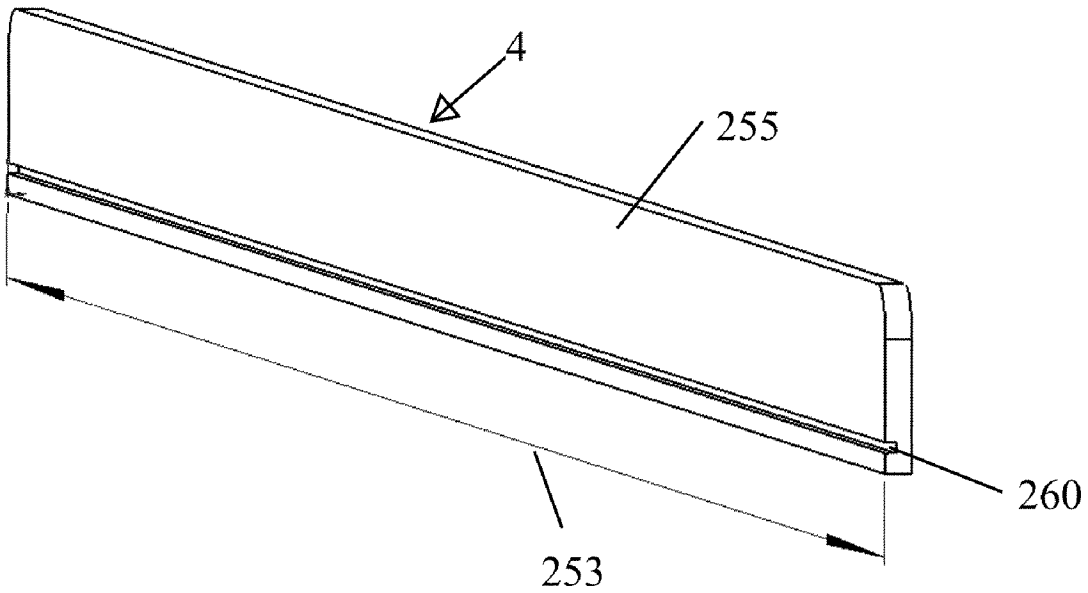
FIG. 9 is a front perspective view of a first retainer and/or a second retainer of the present disclosure.

As shown in FIGS. 8 and 12, second channel member 5 may have a center projection 230 extending from member 215. Center projection 230 is connected to a front member 235. As shown in FIG. 8, center projection 230 and front member 235 form a retainer channel 236. A second retainer 4 may be connectable to retainer channel 236. As shown in FIG. 9, second retainer 4 may have a planar portion 255 and a recess 260. As shown in FIG. 12, front member 235 may have a ridge 245 complementary in shape to recess 260 so that ridge fits 245 within recess 260 when second retainer 4 is connected to retainer channel 236 of second channel member 5, for example, by friction fit. Ridge 240 may be used to hold an item, such as, for example, a price-label extrusion.

First channel member 2 and second channel member 5 are similar, however, are formed to be positioned on opposite edge portions of base units 100, and, thus, the same reference numerals are used for first channel member 2 and second channel member 5. Second channel member 5 and/or first channel member 2 may be any length 228, such as, for example, about 1215 mm or about 1217.52 mm. First retainer 3 and second retainer 4 are similar, however, are formed to be positioned on opposite edge portions of base units 100, and, thus, the same reference numerals are used for first retainer 3 and second retainer 4. Second channel member 5 and/or first channel member 2 may be any length 253, such as, for example, about 1215 mm. Second channel member 5 and/or first channel member 2 may also be used to for other applications, such as, housing electronic a signal, such as, LED lights, electronic pricing or advertising tags.

Figure 13A:
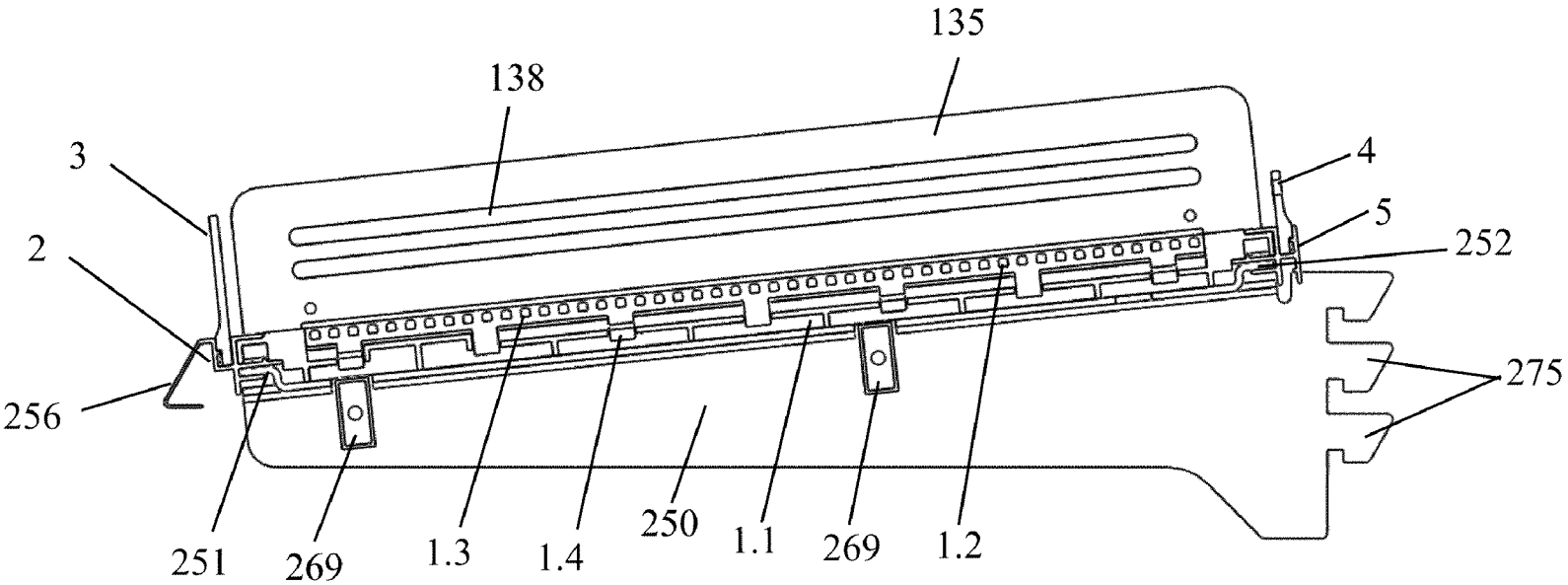
FIG. 13*a* is a side view of a shelving assembly of the present disclosure.
Figure 18:
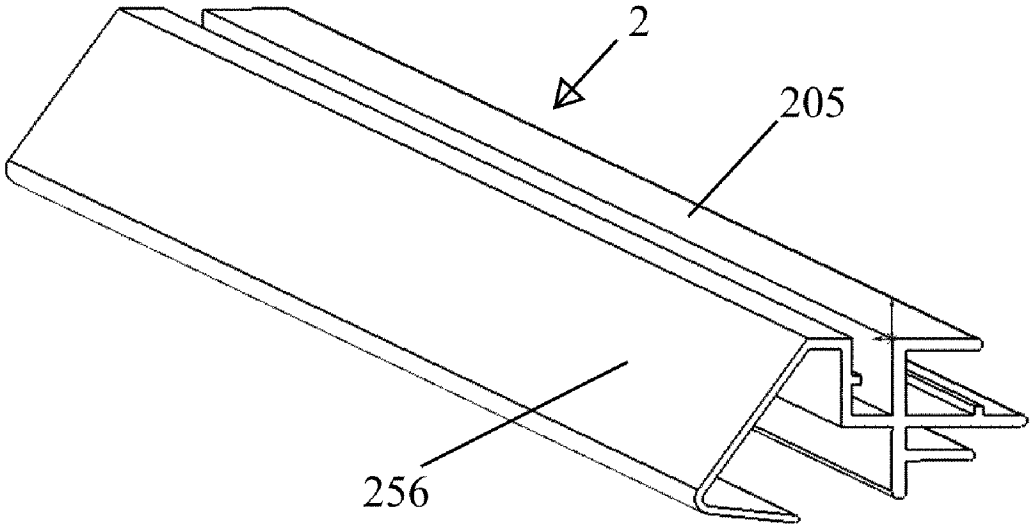
FIG. 18 is a front perspective view of a first channel member having an inclined portion of the present disclosure.
Figure 19:
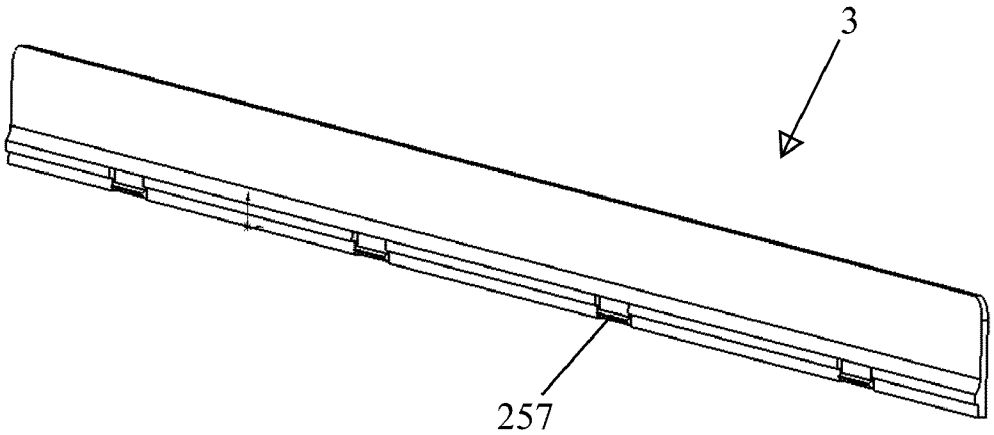
FIG. 19 is a front perspective view of a first retainer having clips of the present disclosure.
Figure 20:
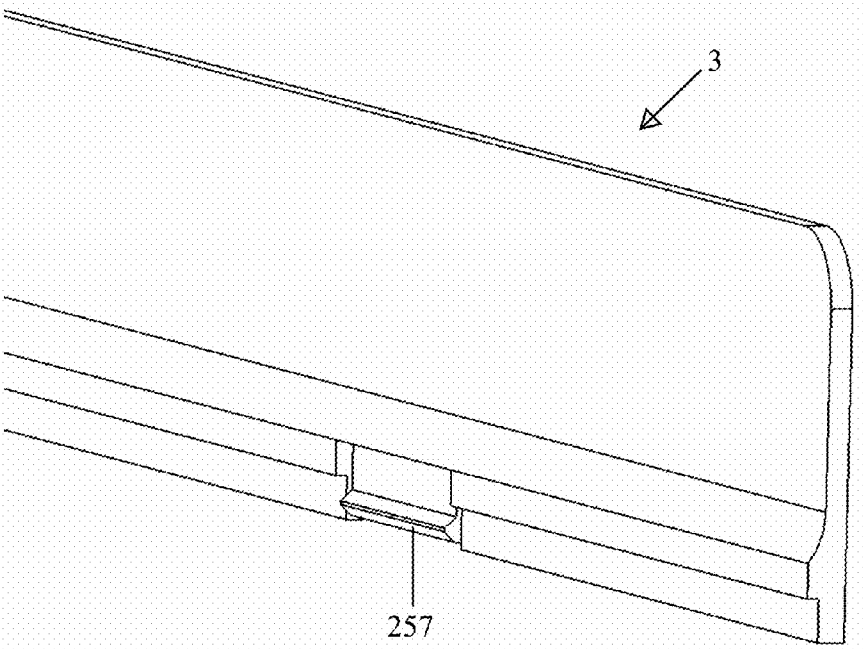
FIG. 20 is an enlarged front perspective view of the first retainer of FIG. 19 of the present disclosure.

In another embodiment shown in FIGS. 18 and 13*a*, first channel member 2 may have an inclined portion 256. Inclined portion 256 provides increased stability to first channel member 2 and provides extra space for displaying advertisements, pricing or other messages. In addition, first retainer 3 may have a clip 257, as shown in FIGS. 19 and 20. Clip 257 may be a "snap" fit or removably inserted into ridge 245 on front member 235 of retainer channel 236, to secure first retainer 3 to first channel member 2. Clip 257 has a size to fit within ridge 245 of retainer channel 236. Clip 257 may be inserted into ridge 245 of retainer channel 236 so that clip 257 is connected to ridge 245 by friction fit. The use of clip 257 provides a more secure connection between first retainer 3 and first channel member 2. This prevents the products being displayed from falling out of the shelving assembly. In addition, first retainer 3 may also be positioned at an angle toward a top end of first retainer 3 to more securely hold the items on display (not shown). This prevents items being displayed on an incline from protruding past the shelving assembly where they may be knocked over.

Figure 21:
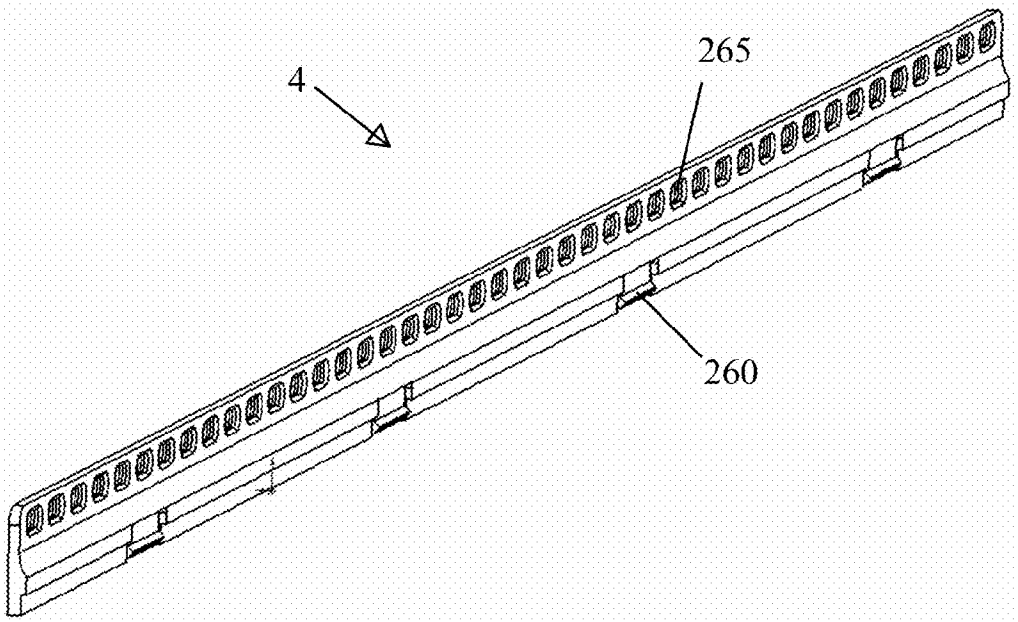
FIG. 21 is a front perspective view of a second retainer having spaces for connecting a mass-pusher assembly of the present disclosure.
Figure 41:
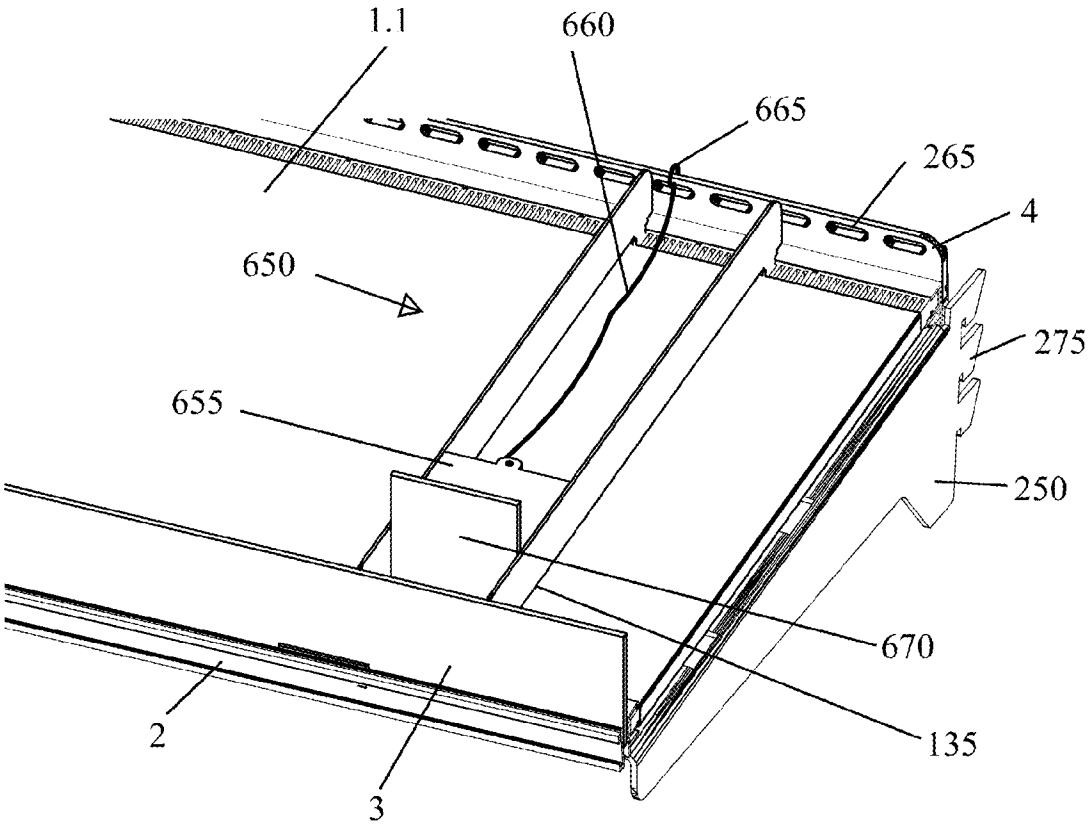
FIG. 41 is a front perspective view of a mass-pusher assembly with a shelving assembly of the present disclosure.

As shown in FIG. 21, second retainer 4 may have a clip 260 that corresponds with ridge 245 of retainer channel 236 of second channel member 5. Clip 260 is attached to second channel member 5 in a similar manner as clip 257 of first retainer 3. Second retainer 4 may also have a plurality of spaces 265 that secure a mass-pusher assembly 650 to the shelving assembly, as shown in FIG. 41.

As shown in FIG. 13, on bottom side 115 of base plate 1.1, shelving assembly 300 has one or more support beam 269, preferably two support beams 269. Support beam 269 is made of a sturdy material, such as steel, and provides added integrity to shelving assembly 300 while in use. As shown in FIGS. 13 and 13*a*, support beams 269 are attached perpendicular to support panels 250 and parallel to first channel member 2 and second channel member 5. Support beams 269 are placed between a pair of support panels 250 located on opposite sides of shelving assembly 300. As shown in FIG. 13*a*, support beams 265 are attached to support panels 250, preferably by screws or welding.

In use, shelving assembly 300 is installed on an incline. A plurality of items are placed on shelving assembly 300 for display. The plurality of items may include small-sized bottles, medium-sized bottles, boxes including drug and vitamins, ink cartridges, beverages, water, food such as yogurt, coffee, candy, jam, dressing; children's food, stationary, pet food, beauty supplies, hardware, gas station items, auto parts and any items that may be displayed on shelving assembly 300 and may move to rotate rollers 1.3. The plurality of items are stacked or positioned one in front of another on plurality of rollers 1.3 so that when one of the plurality of items is removed from shelving assembly 300, the remaining plurality of items slide or move by gravity down the incline rotating plurality of rollers 1.3 on shelving assembly 300. Dividers 135 may be connected to base plate 1.1 on each side of the plurality of items so that the plurality of items fit between the dividers to direct the position and/or movement of the item on shelving assembly 300. First channel member 2 may be connected to shelving assembly 300 to stop the movement of the plurality of items and maintain the plurality of items on shelving assembly 300. Second channel member 5 may be connected to shelving assembly 300 to maintain the plurality of items on shelving assembly 300 between second channel member 5 and first channel member 2.

Figure 10:
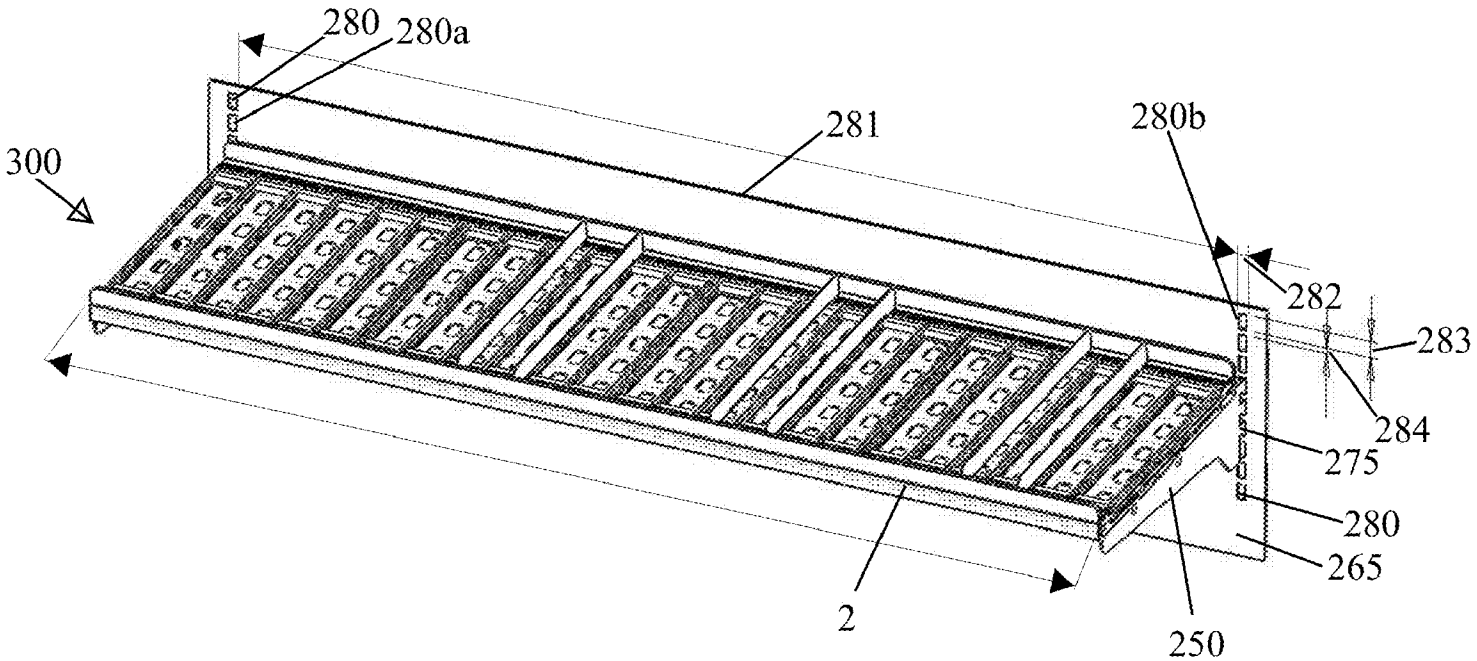
FIG. 10 is a front perspective view of a shelving assembly of the present disclosure.
Figure 11:
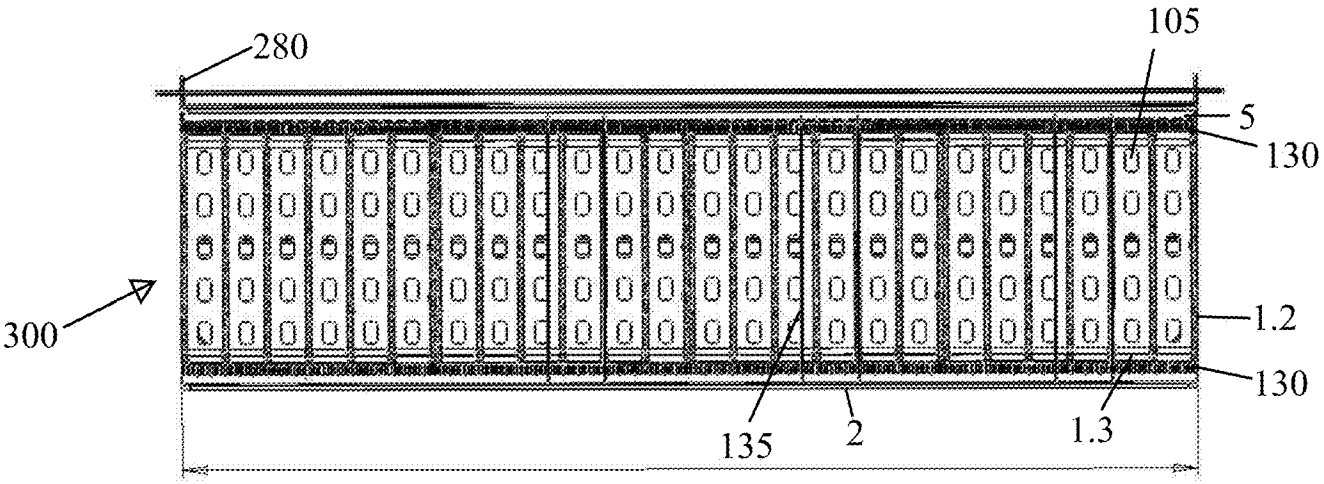
FIG. 11 is a top view of a shelving assembly of the present disclosure.

As shown in FIGS. 10-12, shelving assembly 300 may be installed on the incline by support panel 250. Support panel 250 forms an angle 263 with a track 265. Angle 263 may be any angle that moves the plurality of items on plurality of rollers 1.3 by gravity. Angle 263 may be about 8 degrees, however, it is contemplated by the present disclosure that angle 263 can be any angle between 3 degrees to about 10 degrees, and preferably, is between about 4 degrees to about 6 degrees. Angle 263 depends on the item weight, the heavier the smaller the angle. The smaller the angle, the more space that is useful in vertical.

As shown in FIGS. 10-12, support panel 250 may have one or more hooks 275. Track 265 may have one or more holes 280. Holes 280 may include a first line of holes 280*a* and a second line of holes 280*b*. First line of holes 280*a* and second set of holes 280*b* may be any distance 281 apart, such as, for example, about 1212.85 mm. Holes 280 may be any size to fit hooks 275 therein, such as, for example, a width 282 of about 9.53 mm and a height 283 of about 25.40 mm. Holes 280 may have any space 284 between one another to correspond to hooks 275, such as, for example, about 19.05 mm. The height or position of shelving assembly 300 may be adjusted by disengaging hooks 275 from holes 280 at a first position to remove shelving assembly 300 from track 265 and moving shelving assembly 300 to a second set of holes at a different position or height and engaging hooks 275 in the second set of holes. Shelving assembly 300 may connect to more than one support panel 250 that may similarly connect to track 265. The standard data for holes are as follows: width: ⅜ inch, height: ¾ inch, distance between two holes: ¼ inch, and mean center-center: 1 inch.

As shown in FIGS. 5, 14, and 15, shelving assembly 300 may be installed on the incline by one or more legs 270. Legs 270 have a height of about 1 inch to about 2.5 inches. The height of legs 270 depends on the declined degree. As shown in FIGS. 14 and 15, base plate 1.1 may have one or more leg apertures 290 integrally formed therein. Legs 270 may be inserted into leg apertures 290 to connect legs 270 to base plate 1.1, for example, by friction fit or screws. Shelving assembly 300 may be placed on a horizontal surface 295, such as a deck or a shelf, so that legs 270 form the incline with the horizontal surface, as shown in FIG. 5.

Thus, shelving assembly 300 includes an assembly that minimizes parts. Prior art shelves require about 18-24 pieces in contrast to about 4 to about 10 pieces of shelving assembly 300. Minimizing the parts of shelving assembly 300 minimizes assembly required during manufacture reducing cost and labor and increasing efficiency of assembly. Moreover, as discussed herein, shelving assembly 300 minimizes weight, also reducing cost, and increases structural integrity by ribs 110. Shelving assembly 300 is clear, less dusty, easier to assemble and maintain over prior art spring-pusher systems.

Figure 22:
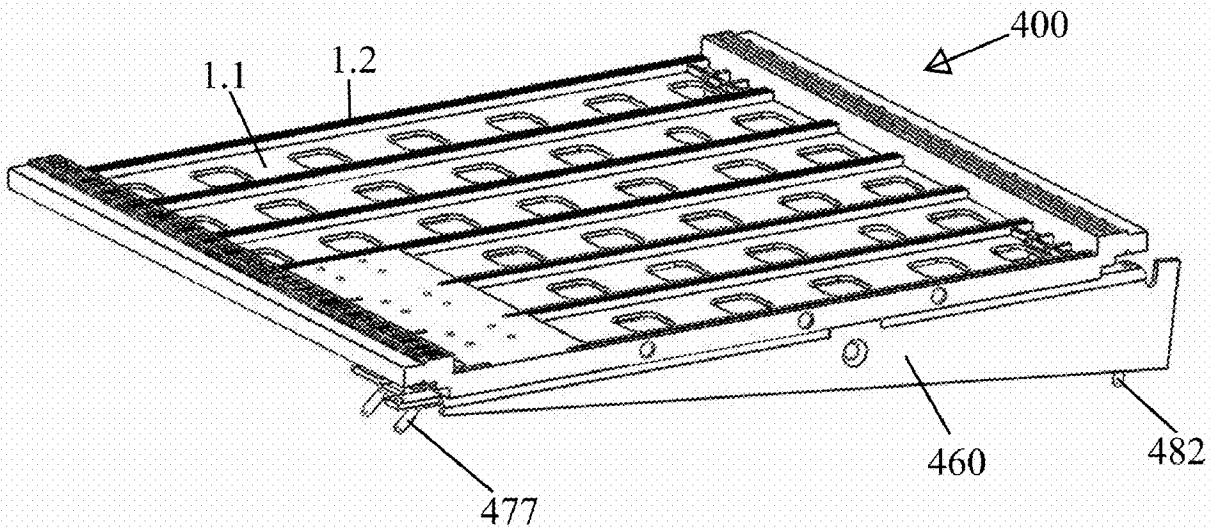
FIG. 22 is a front perspective view of a unit of a shelving assembly of the present disclosure.

In another embodiment, shown in FIG. 22, the shelving assembly is a unit 400. Unit 400 has a base plate 1.1, a plurality of securing members 1.2, a plurality of rollers 1.3 and one or more fastener 1.4. Unit 400 is similar to unit 100, however unit 400 attaches to a deck or shelf.

Figure 23:
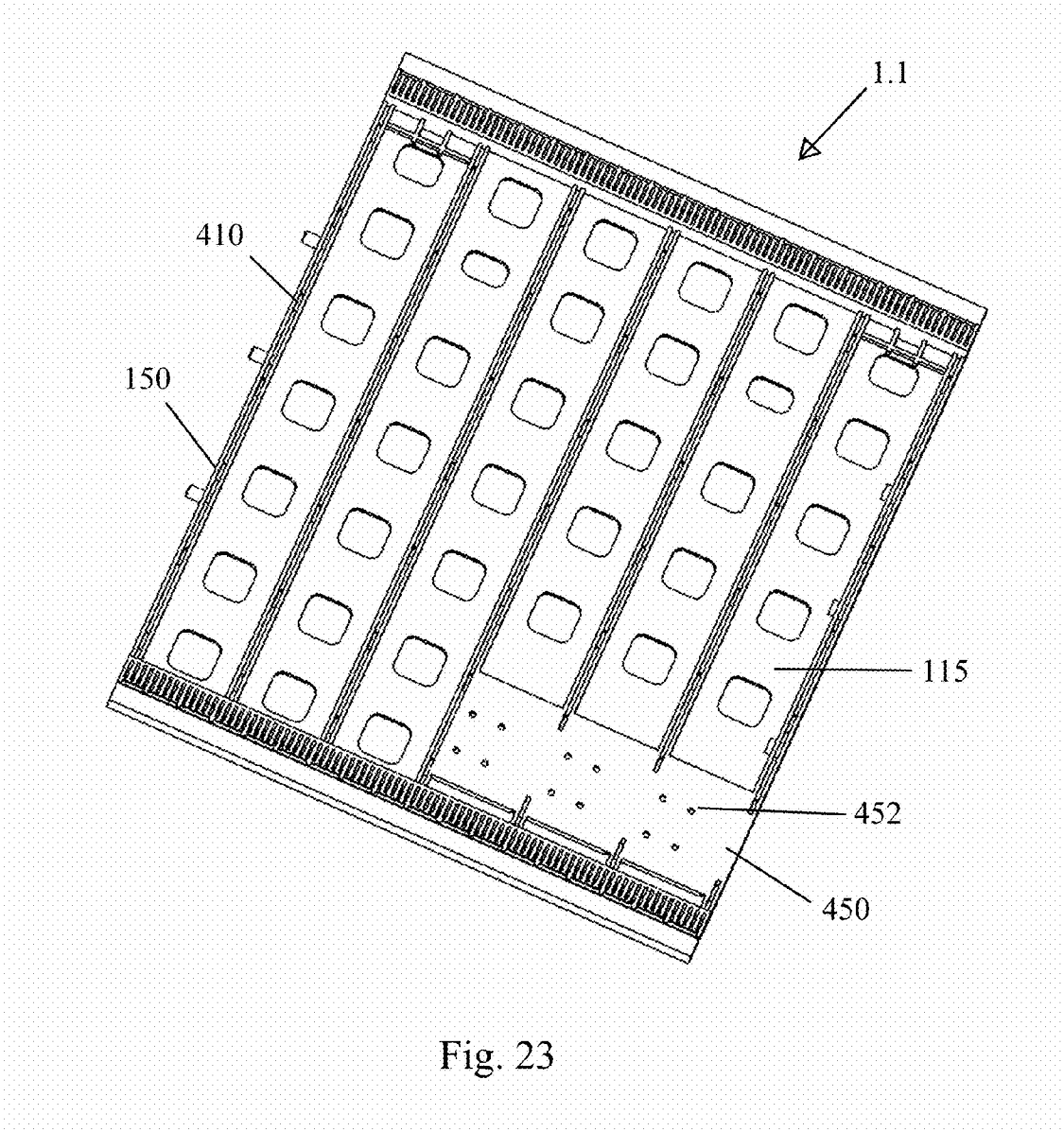
FIG. 23 is a top perspective view of a base plate of the present disclosure.
Figure 24:
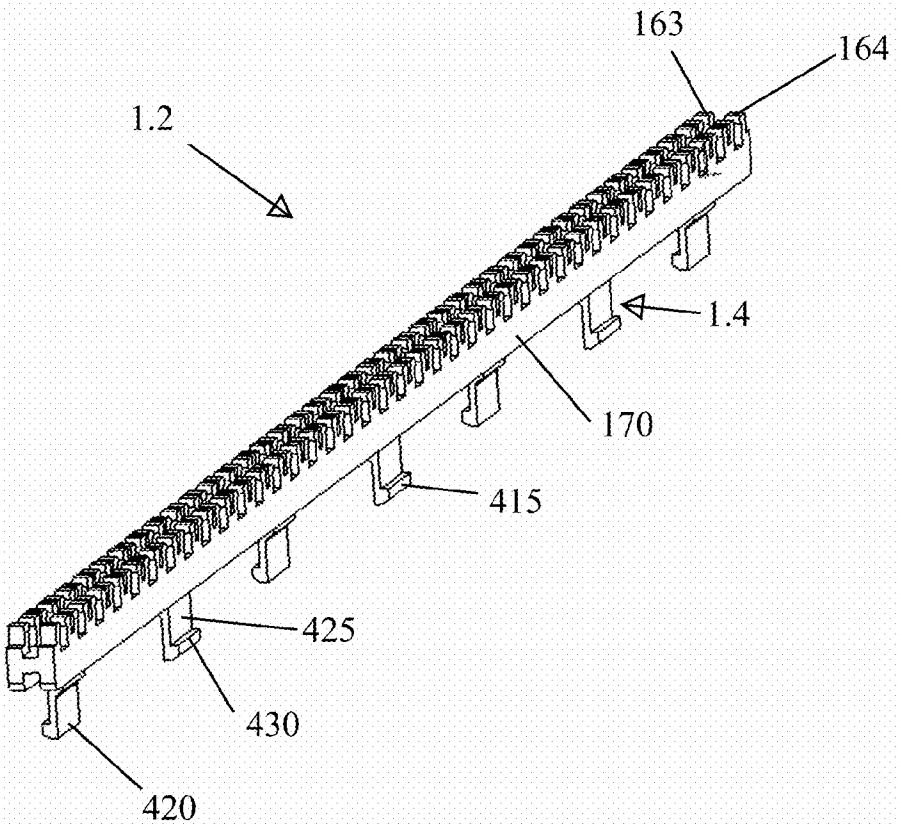
FIG. 24 is a front perspective view of a securing member having clips of the present disclosure.
Figure 25:
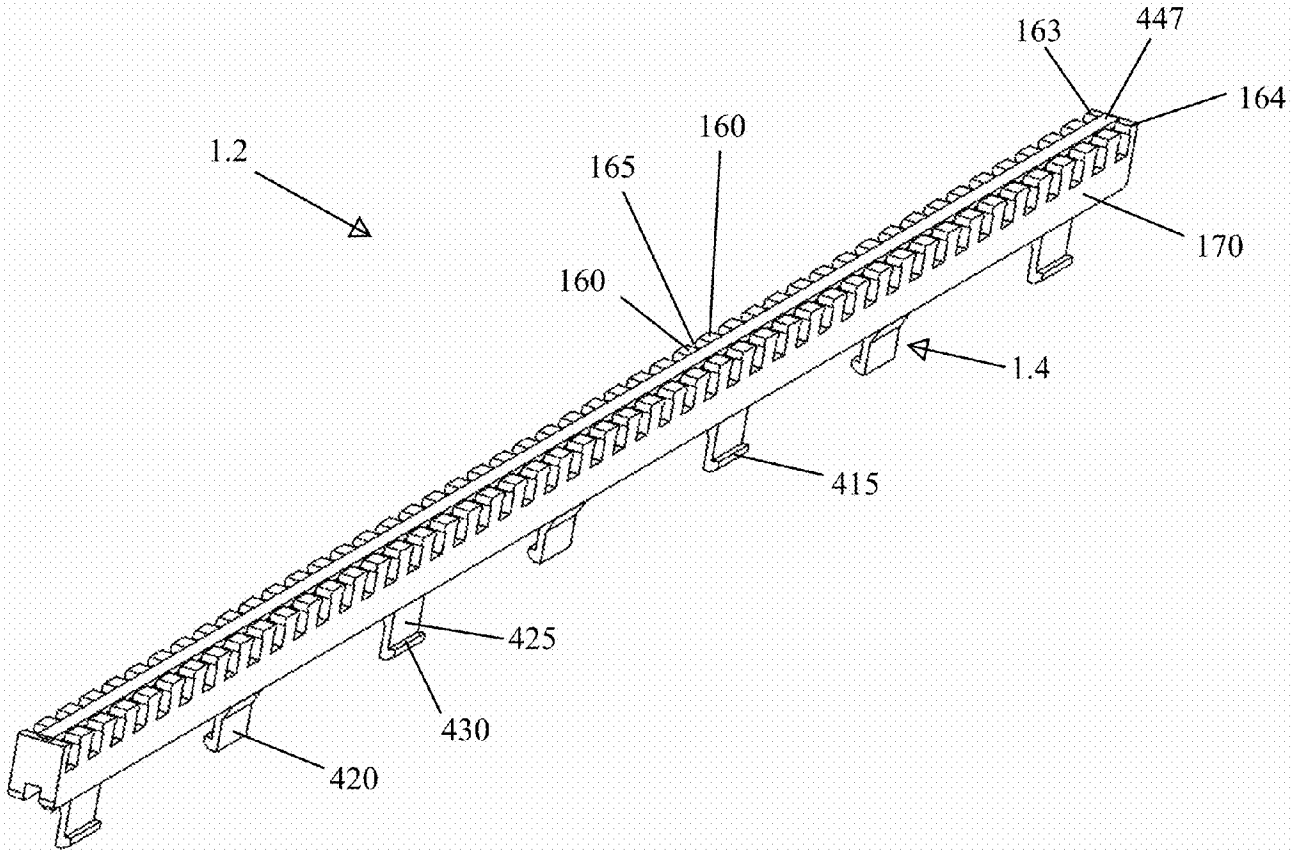
FIG. 25 is a front perspective view of a securing member having clips and a fill bar of the present disclosure.
Figure 26:
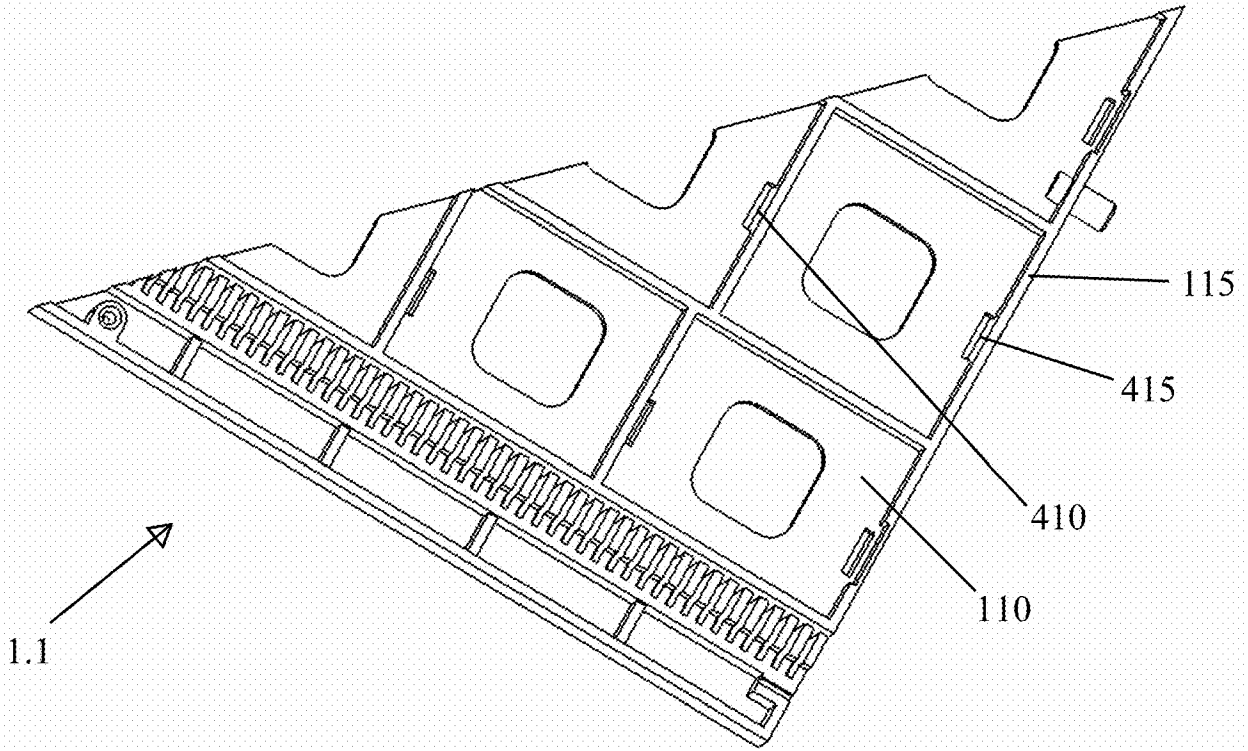
FIG. 26 is an enlarged bottom perspective view of a base plate of the present disclosure.

As shown in FIG. 23, base plate 1.1 has receiving portions 150 integrally formed therewith that receive securing members 1.2 thereon. Receiving portions 150 may have one or more slots 410. As shown in FIGS. 24 and 25, securing member 1.2 may have one or more fastener 1.4. Fastener 1.4 may be clips 415. Clips 415 fit within slots 410 of receiving portion 150 to connect securing member 1.2 to base plate 1.1. FIG. 26 shows the bottom side 115 of base plate 1.1 having slots 410 positioned adjacent to ribs 110, and along the length of base plate 1.1. Securing member 1.2 is connected to base plate 1.1 adjacent to another securing member 1.2 disposed in a parallel relationship.

As shown in FIGS. 24 and 25, clips 415 have a flat surface 420 and a locking surface 425 located on opposite sides of clip 415. Locking surface 425 has a ridge 430. To attach securing member 1.2, clips 415 are inserted into slots 410 of receiving portion 150. Once ridge 430 enters slot 410 a "snap" fit is formed to hold securing member 1.2 to base plate 1.1. Clips 415 are removably inserted into slot 410 of base plate 1.1. The orientation of the flat surface 420 and locking surface 425 of clips 415 may be alternated along the length of securing member 1.2 to provide additional stability and a more secure connection during use. The use of securing member 1.2 having clips 415 eliminates the need for separate screws or plastic pins when attaching to base plate 1.1. This minimizes the number of parts required for assembly and reduces cost of manufacture and labor.

Figure 27:
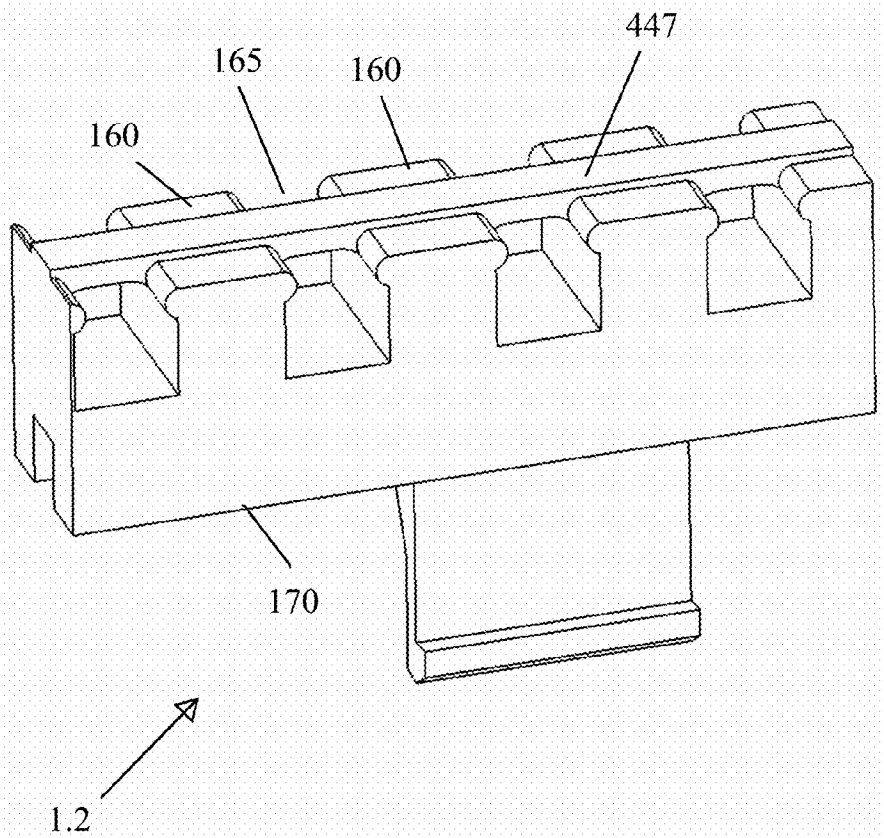
FIG. 27 is an enlarged view of the securing member of FIG. 25 of the present disclosure.
Figure 28:
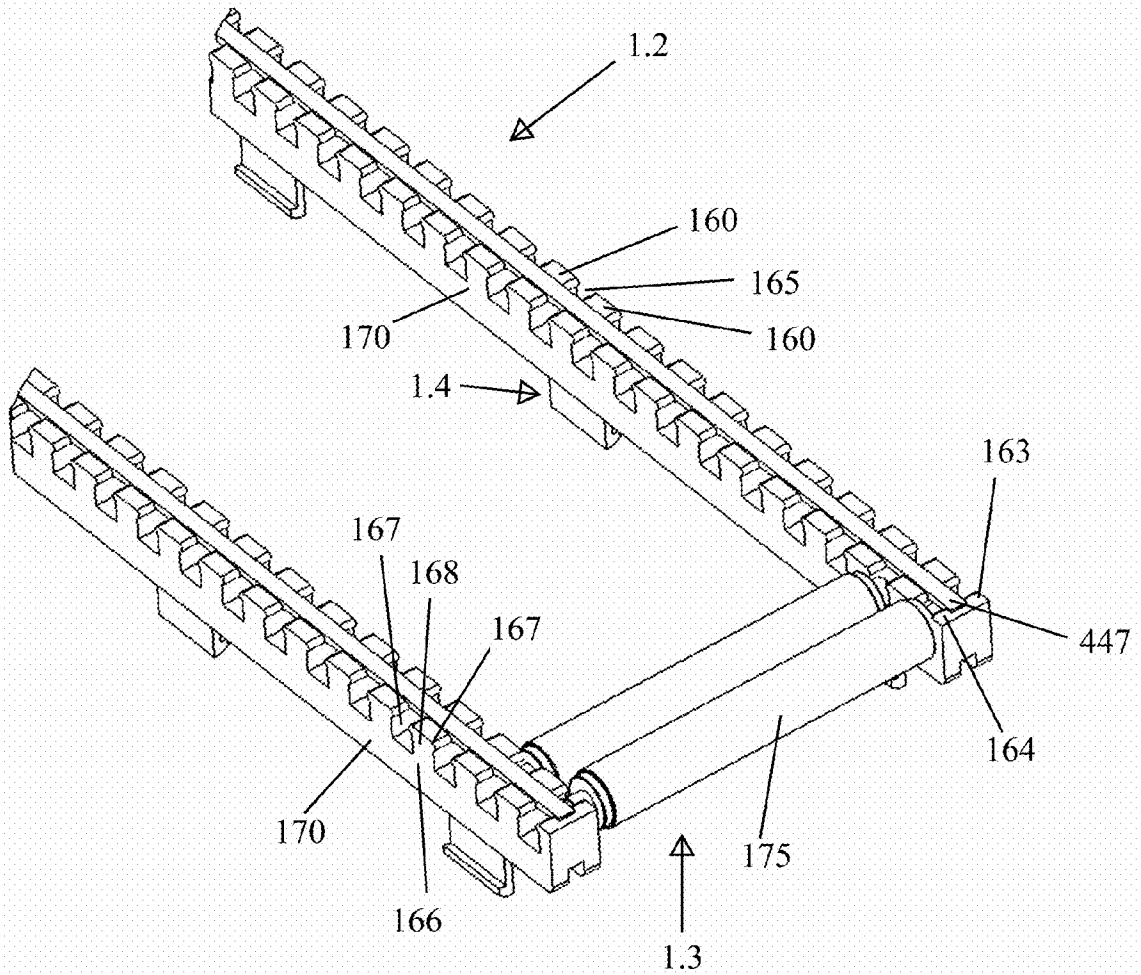
FIG. 28 is a front perspective view of a pair of securing members of FIG. 25 with rollers of the present disclosure.

In another embodiment shown in FIGS. 25 and 27, securing member 1.2 may have a plurality of arm portions 160 along the length of base portion 170. Securing member 1.2 may have first row 163 and second row 164 to connect plurality of rollers 1.3 between adjacent securing members 1.2. As shown in FIG. 28, each arm portion 160 may be connected to securing member 1.2 at a first end 166 that is integrally formed together with base portion 170, and has at least one perturbation portion 167 at a second end 168. As shown in FIGS. 27 and 28, arm portion 160 does not have a space 169 between the pair of perturbation portions 167. FIG. 27 shows securing member 1.2 may have a fill bar 447 along the length of securing member 1.2 eliminating the area between first row 163 of arm portions 160 and second row 164 of arm portions 160. The surface of fill bar 447 is flat, thus providing a flat service for items on a shelving assembly to move down. Fill bar 447 also creates a smooth surface along the top of securing member 1.2 preventing objects and the products being displayed from obstructing rollers 1.3 and allowing products to move down a shelving assembly with ease.

As shown in FIGS. 25 and 27, each pair of adjacent arm portions 160 having at least one perturbation portion 167 forms an opening 165 therebetween. Connection rods 180 of roller 1.3 have a size to fit within opening 165. As shown in FIG. 28, connection rods 180 may be a "snap" fit or removably inserted into opening 165 between the perturbation portions 167 of each pair of adjacent arm portions 160 so that connection rod 180 is connected by friction fit. Each roller 1.3 can rotate while connected between adjacent arm portions 160. Connection rods 180 do not extend under fill bar 447, thus rollers 1.3 are not held in place by fill bar 447.

Figure 29:
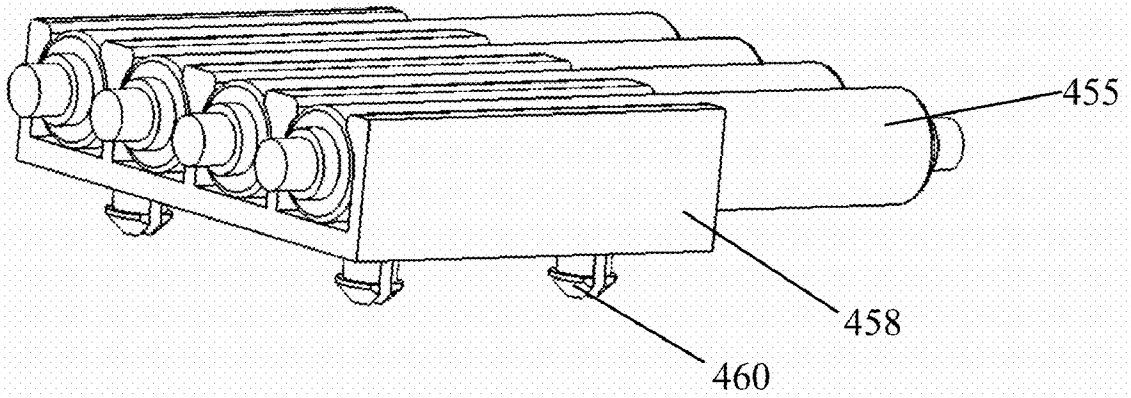
FIG. 29 is a front perspective view of a storage bracket with spare rollers of the present disclosure.

As shown in FIGS. 23 and 13, base plate 1.1 may have a roller storage area 450 on bottom side 115 of base plate 1.1. Roller storage area 450 does not contain apertures 150; instead it has a plurality of bracket holes 452 within base plate 1.1. As shown in FIG. 29, spare rollers 455 are held within a storage bracket 458 that has one or more bracket protrusions 460. Storage bracket 458 can have any number of bracket protrusions 460 to attach to storage area 450. Bracket protrusions 460 have a size to fit within bracket holes 452. Bracket protrusions 460 may be "snap" fit or removably inserted into bracket holes 452. Roller storage area 450 eliminates the need to store spare rollers 455 in a location separate from the shelving assembly where they can get lost or be misplaced. Spare rollers 455 are located on base plate 1.1 allowing the user to easily and conveniently replace damaged or missing rollers 1.3.

Figure 30:
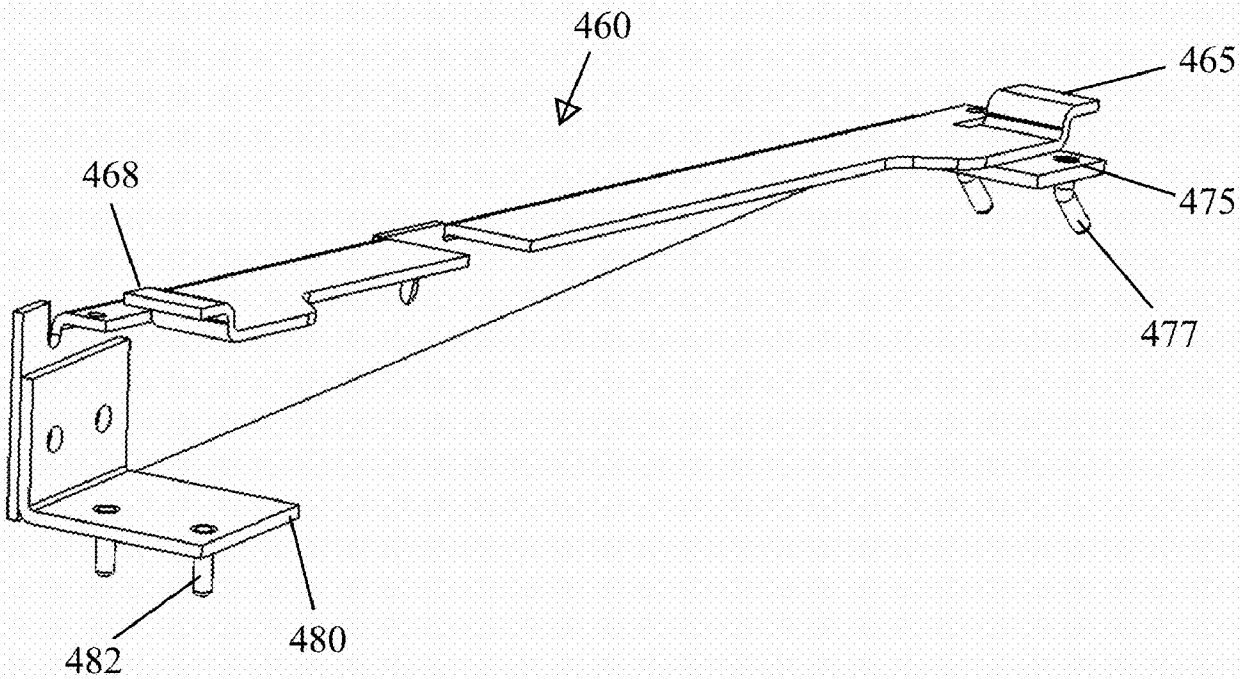
FIG. 30 is a rear perspective view of a support panel of the present disclosure.
Figure 32:
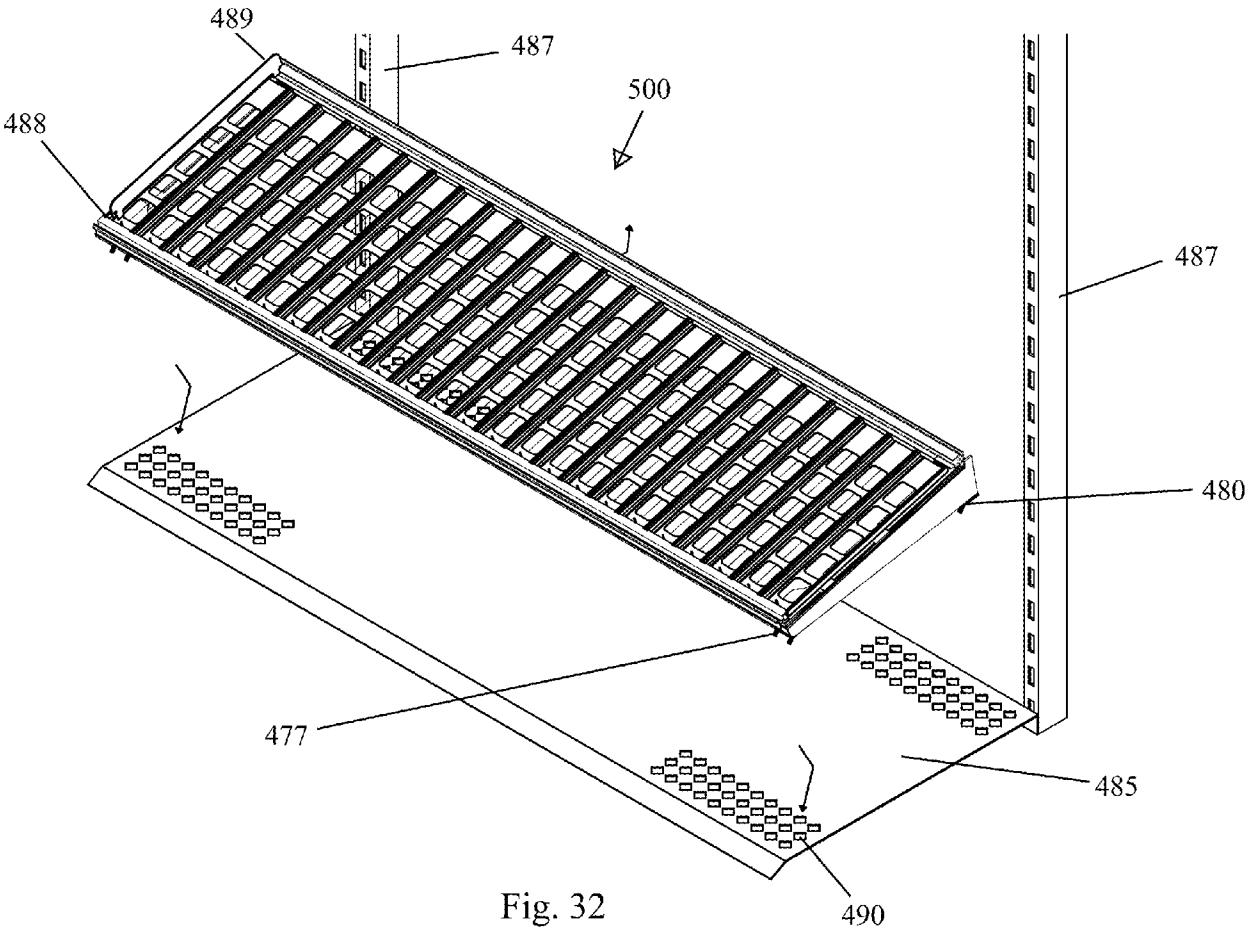
FIG. 32 is a front perspective view of a shelving assembly of the present disclosure.

As shown in FIG. 22, to secure unit 400 to a deck or a shelf 485 (FIG. 32), each side of base plate 1.1 is attached to a support panel 460. Unit 400 may be used as a shelving assembly, or, as shown in FIG. 32, one or more units 400 may be connected to form fixed assembly 500. Support panel 460 is made of a sturdy material similar to support panel 250, such as steel. Support panel 460 has a length to accommodate the corresponding base plate 1.1. First channel member 2 and second channel member 5 are attached to base plate 1.1 as described for unit 100. As shown in FIG. 30, support panel 460 has a first tab 465 and a second tab 468 at opposite ends. First channel member 2 and second channel member 5 are secured to first tab 465 and second tab 468 as described for unit 100, allowing unit 400 to be removably connected to support panel 460.

Figure 31:
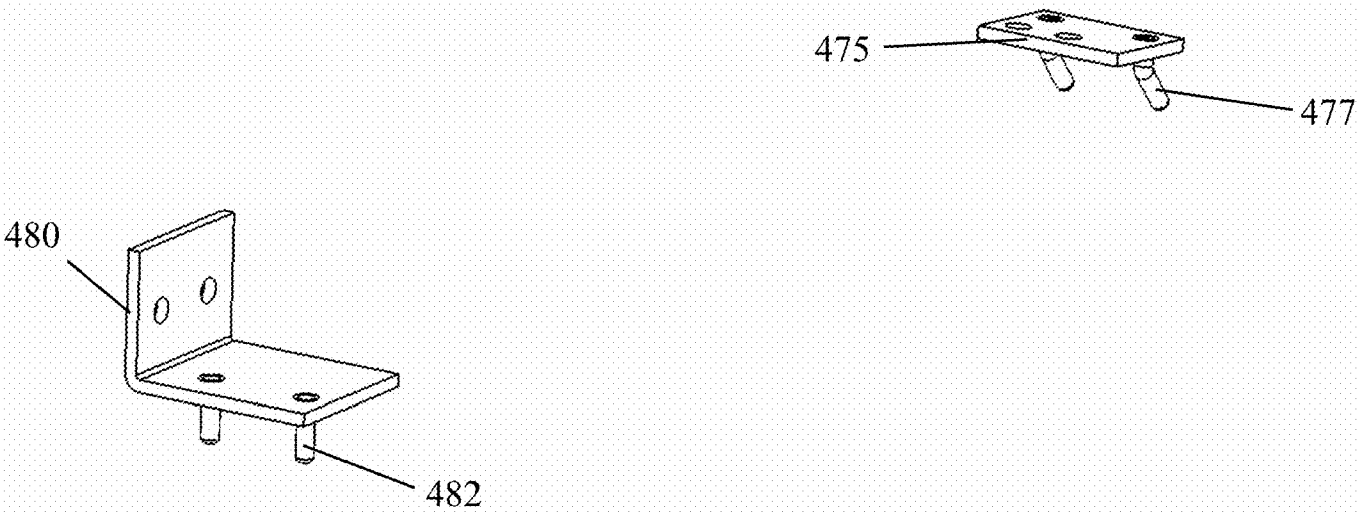
FIG. 31 is a rear perspective view of a front mount and a rear mount of the present disclosure.

As shown in FIGS. 30 and 31, support panel 460 has a front mount 475 and a rear mount 480. Front mount 475 and rear mount 480 are made of a sturdy material, such as steel, and are attached to support panel 460 by screws or welding. At least one front post 477 is attached to the bottom of front mount 475 and at least one rear post 482 is attached to the bottom of rear mount 480. Front post 477 and rear post 482 are made of a sturdy material, such as high-strength steel, and are welded or screwed onto front mount 475 and rear mount 480, respectively. Front post 477 is positioned at an angle in relation to front mount 475. Rear post 482 is straight and positioned perpendicular to rear mount 480. Front post 477 and rear post 482 are used to attach fixed assembly 500 to a deck or shelf 485 by corresponding holes 490, as shown in FIG. 32. Deck or shelf 485 may be adjusted along tracks 487 to allow deck or shelf 485 to be set at any level desired by the user. Tracks 487 can accommodate multiple deck or shelves 485.

Figure 33:
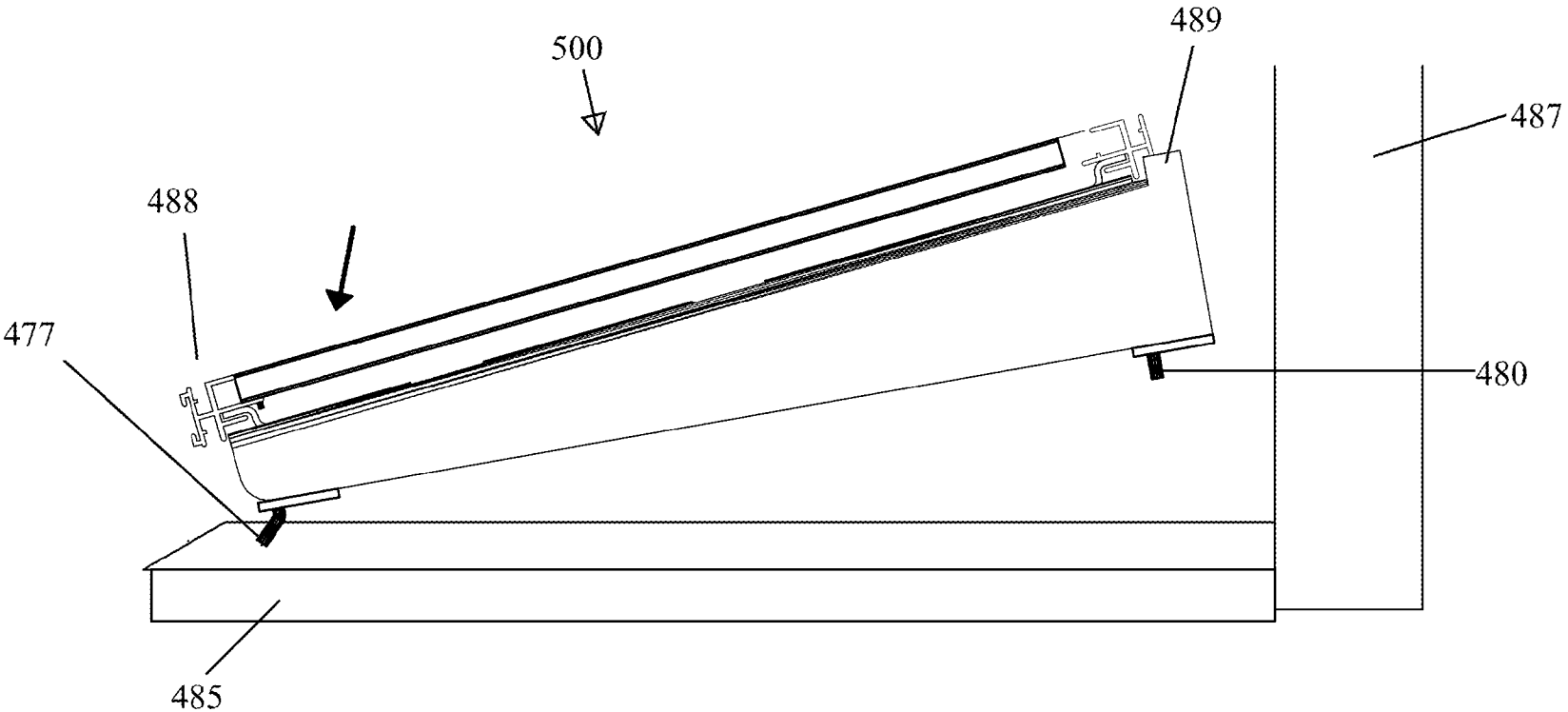
FIG. 33 is a side view of the shelving assembly of FIG. 32 of the present disclosure.
Figure 34:
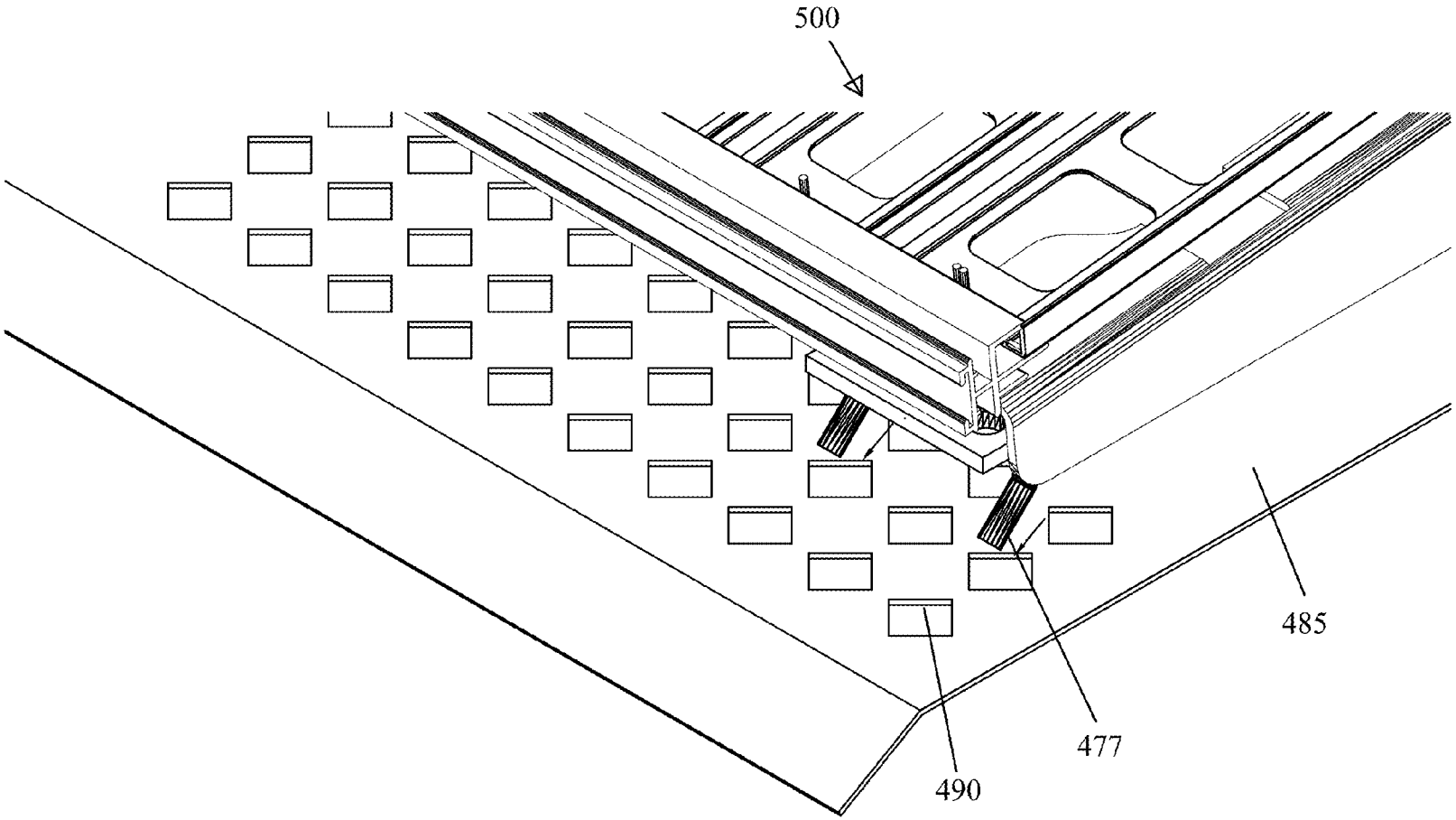
FIG. 34 is an enlarged front perspective view of a front mount of the shelving assembly of FIG. 32 of the present disclosure.
Figure 35:
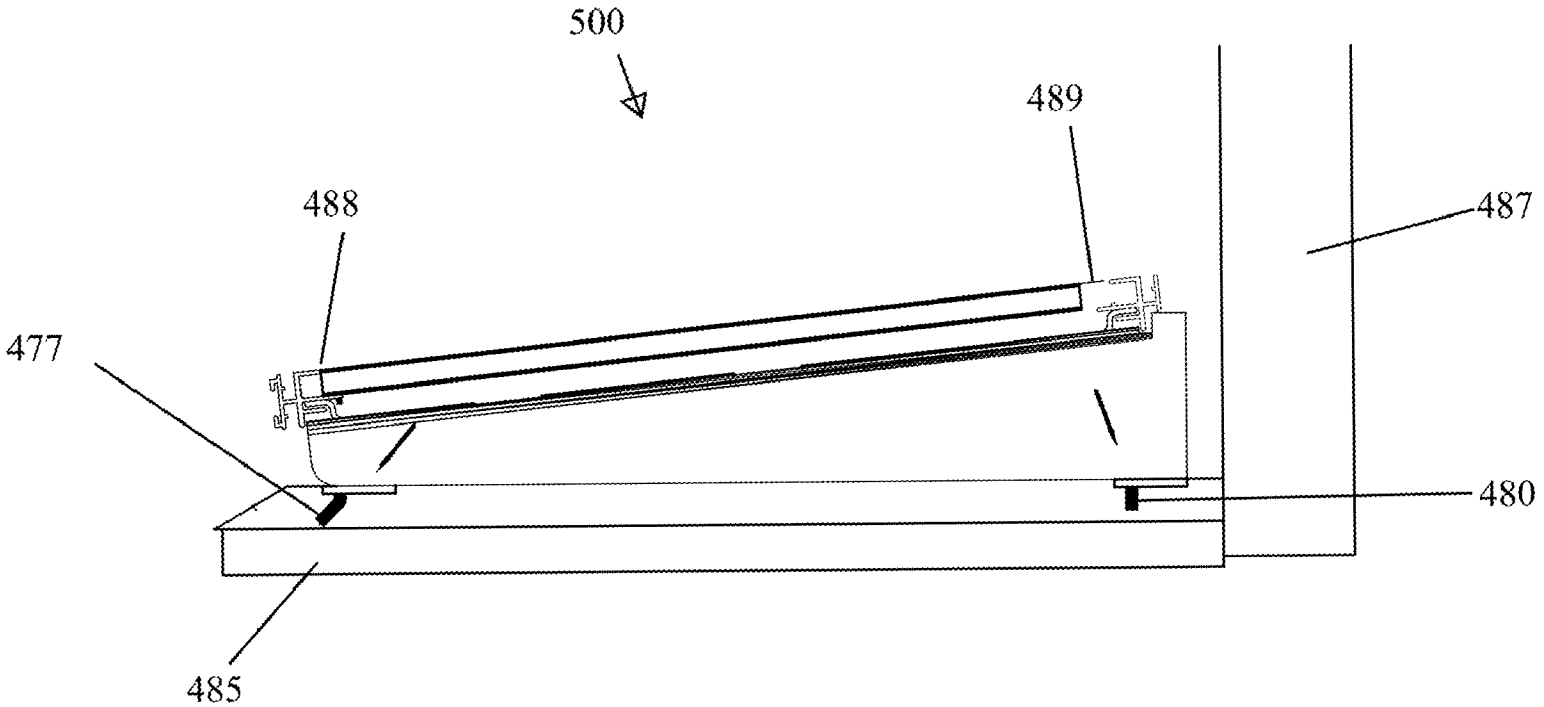
FIG. 35 is a side view of the shelving assembly of FIG. 32 of the present disclosure.
Figure 36:
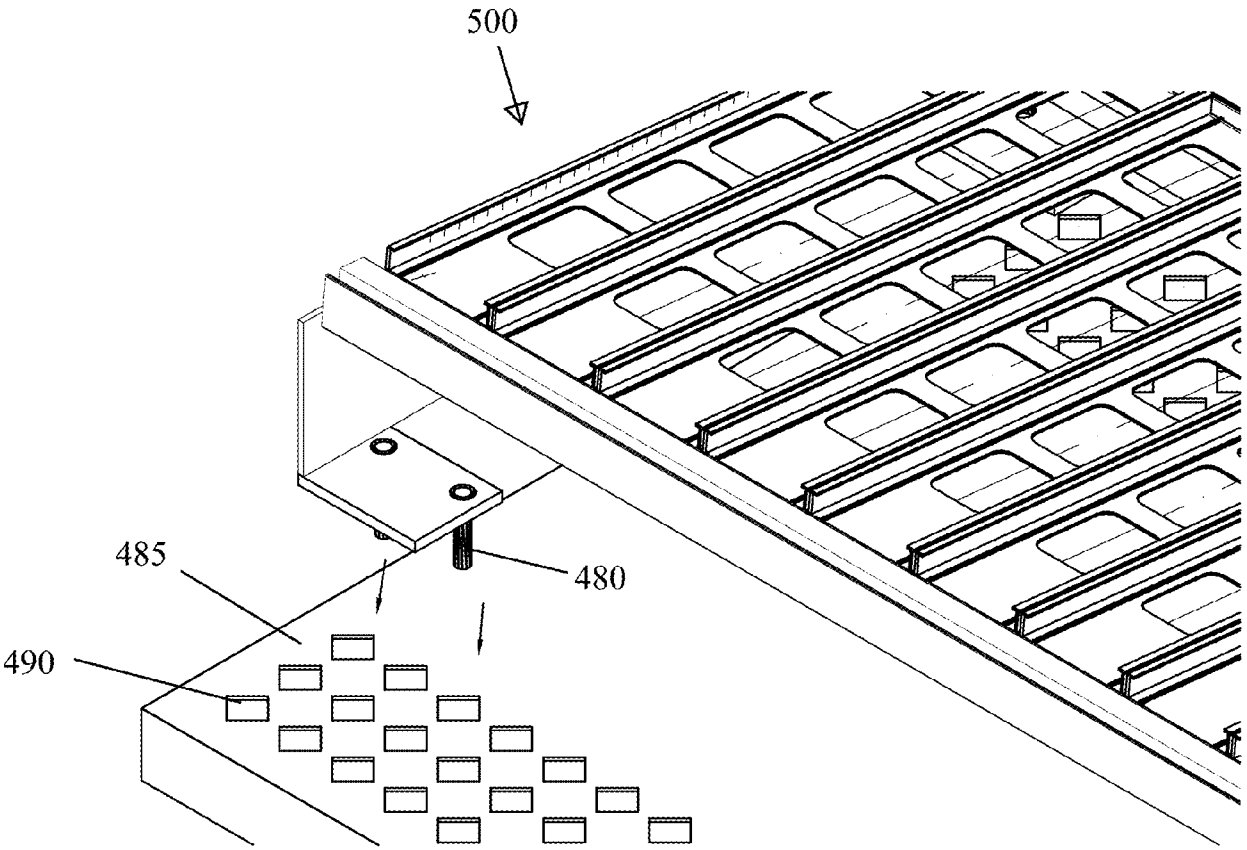
FIG. 36 is an enlarged rear perspective view of a rear mount of the shelving assembly of FIG. 32 of the present disclosure.
Figure 37:
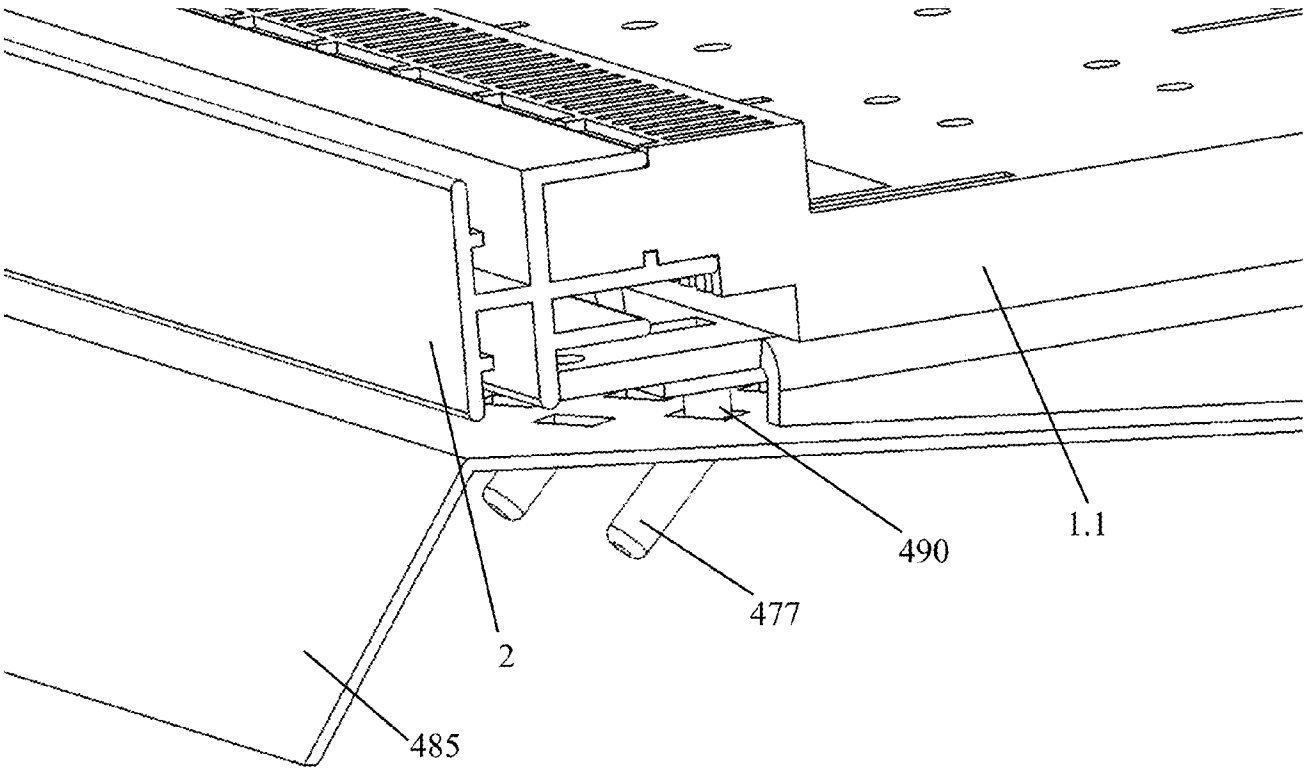
FIG. 37 is an enlarged front perspective view of a front mount of a shelving assembly connected to a deck or shelf of the present disclosure.
Figure 38:
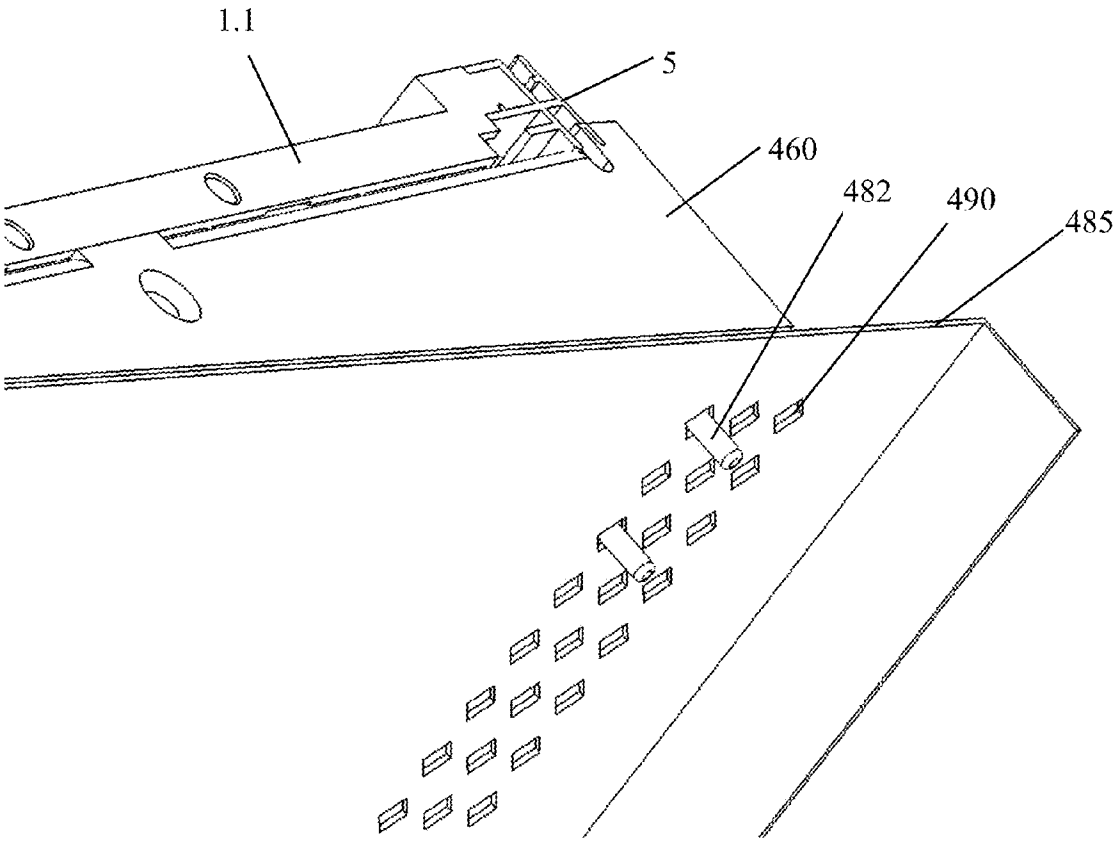
FIG. 38 is an enlarged bottom perspective view of a rear mount of a shelving assembly connected to a deck or shelf of the present disclosure.

To attach fixed assembly 500 to deck or shelf 485, front post 477 and rear post 482 are inserted into holes 490. Deck or shelf 485 can have any number of holes 490 arranged in rows. Preferably, deck or shelf 485 has a front row of holes 490 and a rear row of holes 490 in the areas corresponding with front posts 477 and rear posts 482, as shown in FIG. 32. To secure fixed assembly 500, the second edge portion 489 of fixed assembly 500 is slightly raised to allow the angled configuration of front posts 477 to be inserted into the front row of holes 490 of deck or shelf 485, as shown in FIGS. 33 and 34. The second edge portion 489 of fixed assembly 500 is then lowered allowing rear posts 482 to be inserted into the rear holes of deck or shelf 485, locking fixed assembly 500 into place, as shown in FIGS. 35 and 36. Once attached, the angle of front posts 477 prevent the first edge portion 488 of fixed assembly 500 from moving forward or backward along shelf 485 and from being lifted up off deck or shelf 485, as shown in FIG. 37. Rear posts 482 prevent the second edge portion 489 of fixed assembly 500 from moving forward or backward along deck or shelf 485, but second edge portion 489 of fixed assembly 500 can be lifted up, as shown in FIG. 38. To remove fixed assembly 500, the second edge portion 489 of fixed assembly 500 is lifted up and then back in order to release front posts 477 from holes 490 of deck or shelf 485. In another embodiment, rear posts 452 can be designed at an angle in relation to rear mount 480.

Figure 39:
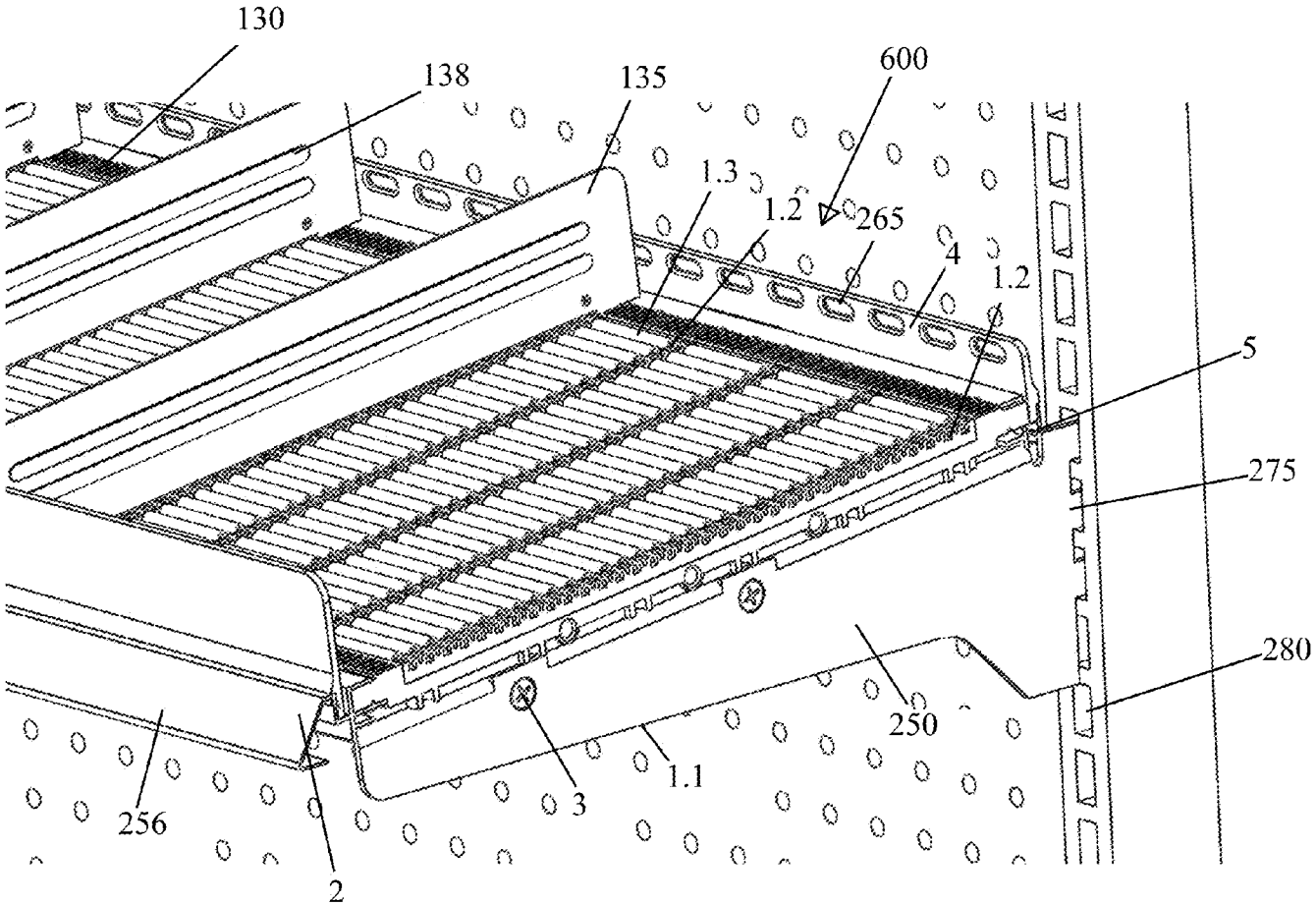
FIG. 39 is a front perspective view of a shelving assembly of the present disclosure.
Figure 40:
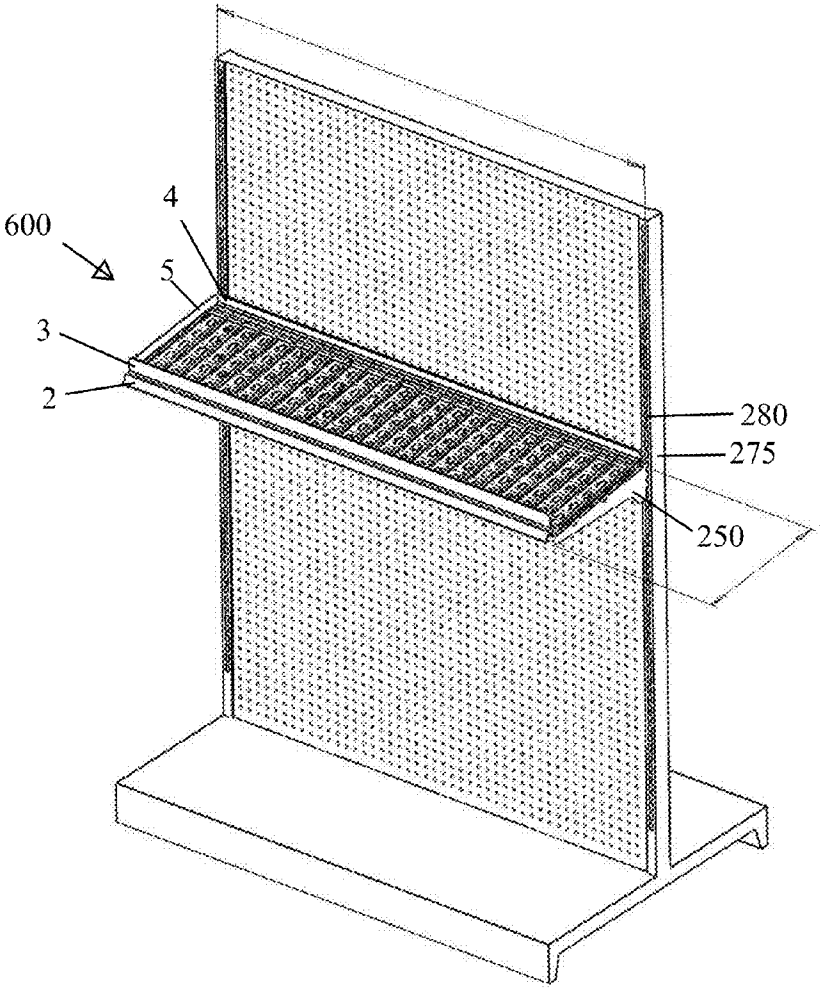
FIG. 40 is a front perspective view of a shelving assembly of the present disclosure.

Fixed assembly 500 is an assembly that provides a more secure attachment to a deck or shelf. Prior assemblies do not have features to prevent the assembly from being lifted off the shelf at the first edge portion 488, thus increasing the chance the display items to fall. The use of angled front posts 477 provide a locking mechanism to secure fixed assembly 500 to the deck or shelf, thus preventing fixed assembly 500 from being pulled off. Therefore, fixed assembly 500 provides a sturdy and safe display for a variety of products. FIGS. 39 and 40 show another embodiment of the present disclosure, hanging assembly 600.

Figure 42:
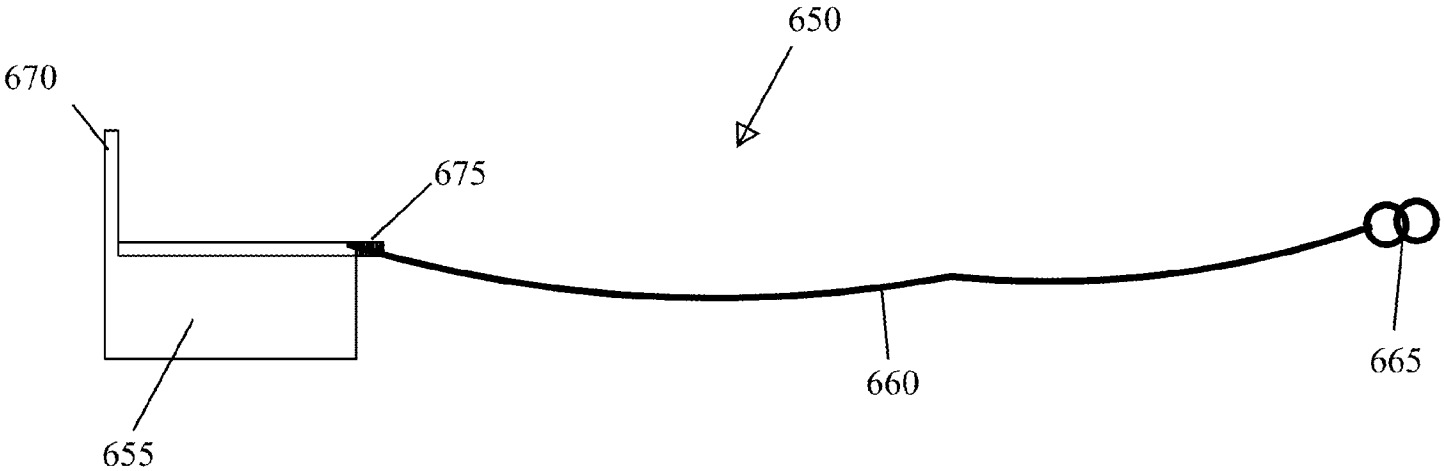
FIG. 42 is a side view of the mass-pusher assembly of the present disclosure.

FIGS. 41 and 42 show the mass-pusher assembly 650 according to the present disclosure. Mass-pusher assembly has a weight 655, a tether 660 and a hook 665. Mass-pusher assembly is attached to a shelving assembly at spaces 265 of second retainer 4.

Weight or mass 655 functions to produce an appropriate amount of mass or pressure on a display item or a series of display items on a shelving assembly, so as to continuously maintain an item at the front portion of the self, thereby providing easy retrieval by a customer. Mass 655 can have any shape, such as square, cylindrical, cylindroid, curved or others to allow mass 655 to be plush against the item being displayed. Mass 655 may have an additional cap or attachment to change shape of the mass 655. Mass 655 is made from an outer material 668 and having a massed material enclosed within. Outer material 668 can be made from acrylic, metal, plastic, wood or other material. Preferably, a bottom panel 672 of mass 655 is composed of a less-fraction material. Enclosed within mass 655 is a massed material to increase the mass of mass 665. The massed material can be any material, such as, but not limited to, steel chips. The mass of mass 655 can be adjusted as needed by adding or removing the massed material. Mass 665 has a width 676 and a height 678 that may be fixed or adjustable. Width 676 can be any width needed by the user, such as 1 inch, 2 inches, 2.5 inches, 4 inches or any other. Height 678 can be any height needed by the user, such as 2.5 inches, 3 inches, 4 inches or any other. Mass 655 has a front panel 670 that rests against the display item. Adjusting the dimensions of front panel 670 allows items of various sizes to be held securely within the shelving assembly.

Figure 43:
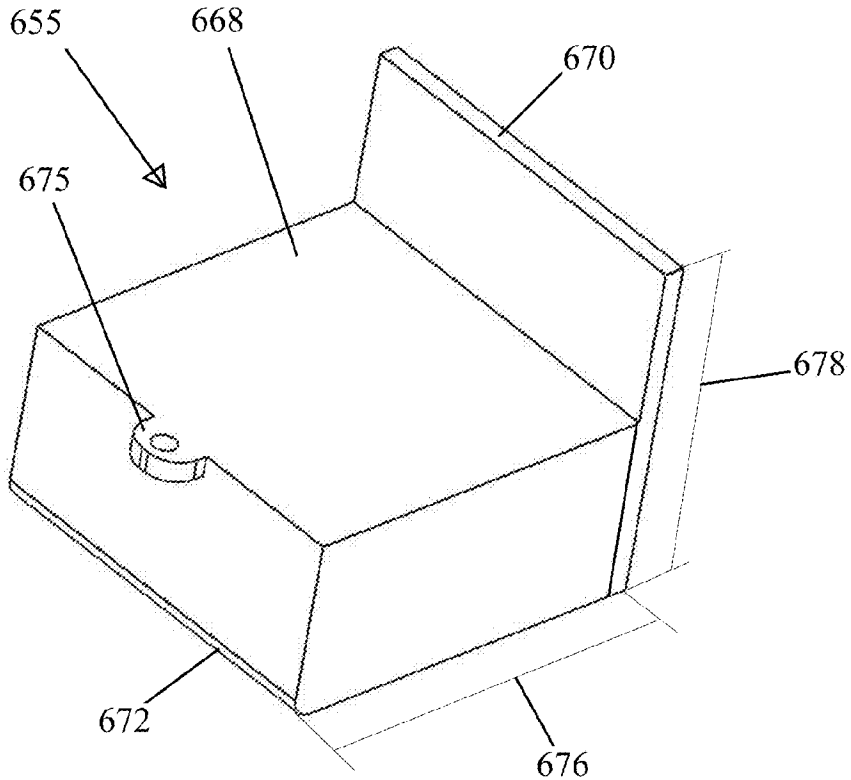
FIG. 43 is a back perspective view of a weight of the mass-pusher assembly of the present disclosure.

Tether 660 functions to connect mass 655 to back rail 4 of the shelving assembly. Tether 660 is attached to mass 655 at back connector 675, as shown in FIGS. 42 and 43. Tether 660 has one or more hooks 665 at the opposite end of the connection to mass 655. Tether 655 has a shape like a straight thread, coil or thread within coil, and can be made of nylon, metal or any other material. Tether 665 must have sufficient strength to prevent breaking while mass-pusher assembly 650 is in use. As shown in FIG. 41, tether 665 should have a length to hold mass 655 a distance away from first retainer 3 when fully extended, preferably about 0.5 to about 1 inch from first retainer 3.

Hook or fastener 665 functions to secure mass 655 with tether 660 to back rail 4 or other portion of the unit or shelving assembly. Fastener 665 preferably attaches to space 265 on back rail 4. The fastener can be made of any material, such as, metal, plastic or any other.

Figure 44:
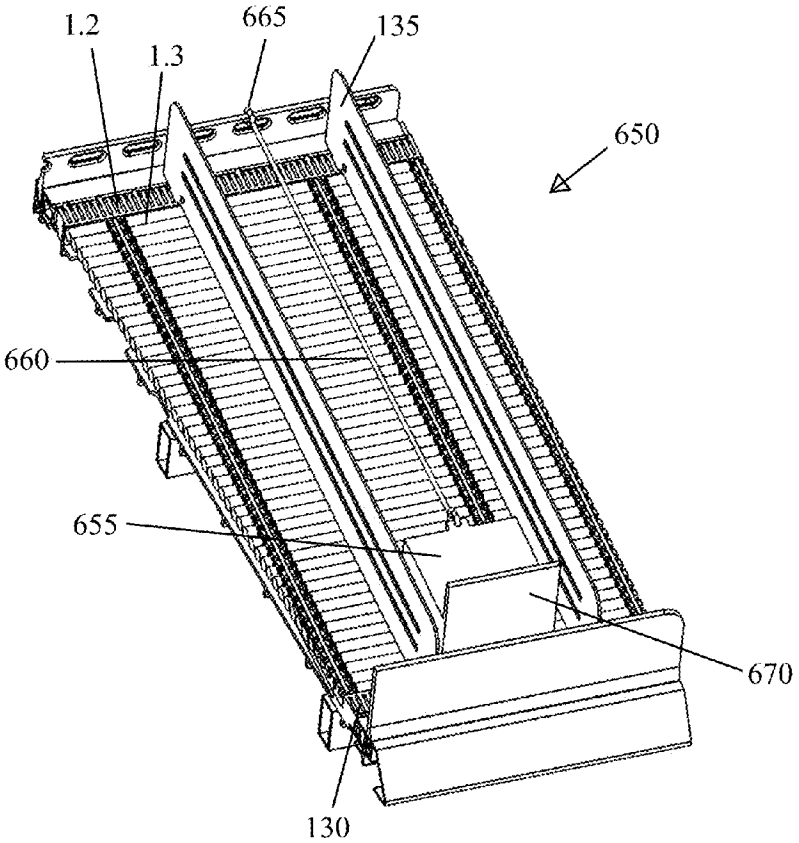
FIG. 44 is front perspective view of the mass-pusher assembly in use with a shelving assembly of the present disclosure.
Figure 45:
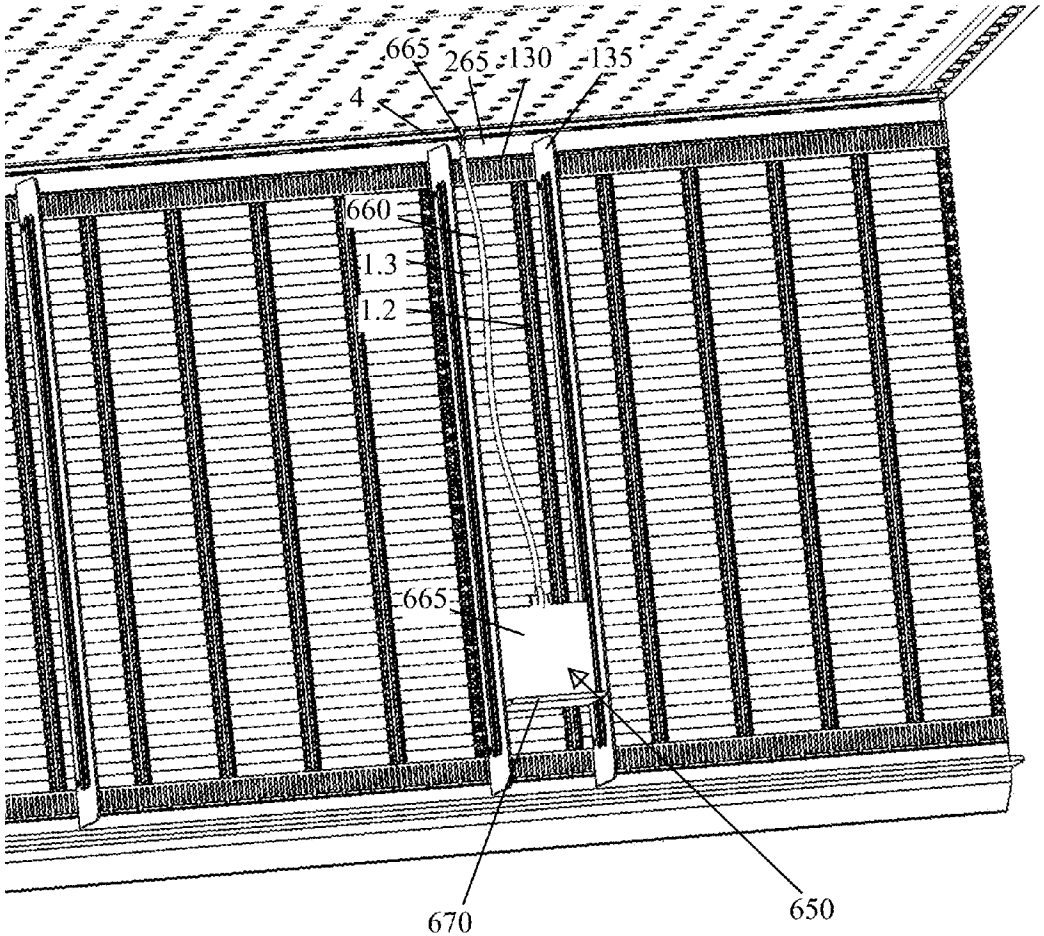
FIG. 45 is front perspective view of the mass-pusher assembly in use with a shelving assembly of the present disclosure.
Figure 46:
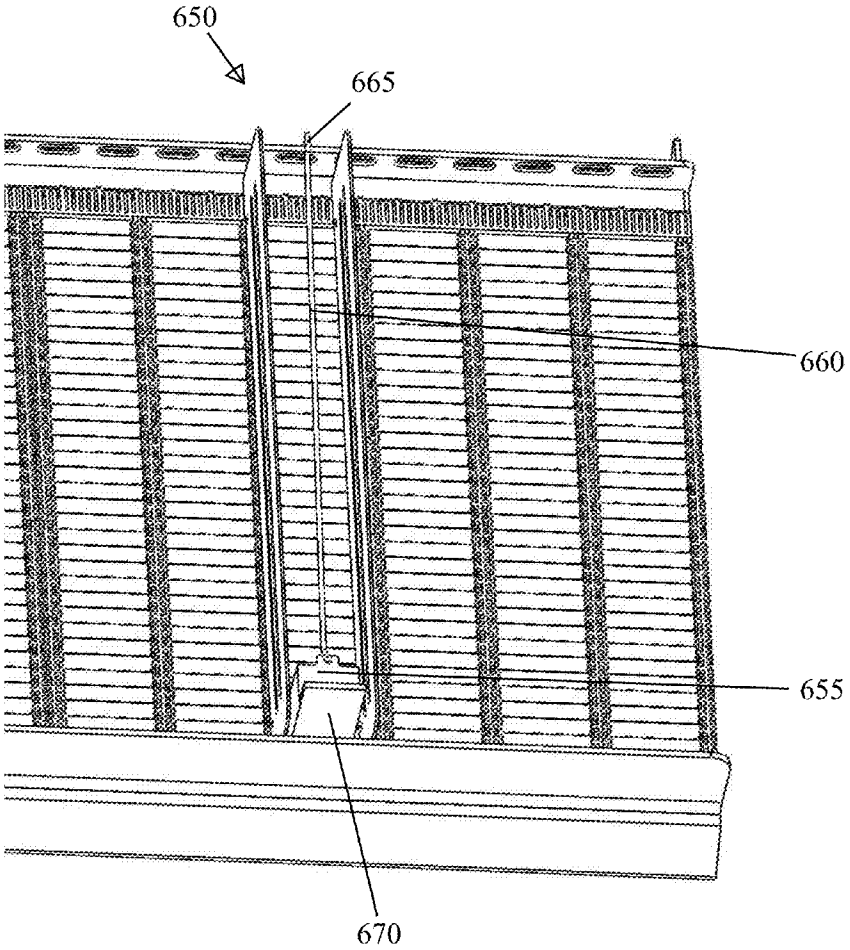
FIG. 46 is front view of the mass-pusher assembly in use with a shelving assembly of the present disclosure.

FIGS. 44-46 show the mass-pusher assembly 650 in use with a shelving assembly according to the present disclosure.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A shelving assembly comprising:

at least one unit that comprises:

a base plate;

a plurality of securing members disposed in a parallel relationship on said base plate, wherein each said securing member includes a plurality of snap fit openings; and a plurality of rollers that each comprise a centrally disposed cylindrical portion and a pair of connection rods extending from opposite ends of said cylindrical portion, wherein each said roller is securely disposed within a pair of oppositely disposed snap fit openings disposed on adjacent securing members, wherein the secured rollers are capable of radial rotation within said openings, and wherein each said snap fit opening comprises adjacent arm portions, each said arm portion having a first end integrally formed together with a base portion of said securing members and a second end having at least one projecting perturbation portion, wherein each of said at least one perturbation portion of said arm portion is disposed opposite said at least one perturbation portion of said adjacent arm portion, wherein said connection rods of each said roller are disposed within each said snap fit opening such that each said roller rotates within said opening, while also prohibiting the removal of each said roller from each said opening without the application of a force sufficient to urge respective perturbation portions of the oppositely disposed arm portions apart such that said connection rod passes through respective perturbation portions of each arm portion, wherein each said securing member comprises a first row of at least four said arm portions and a horizontally spaced apart second row of at least four said arm portions.

2. The shelving assembly of claim 1, wherein said base plate further comprises a first and a second edge portion disposed substantially perpendicular to said securing members, wherein said first and second edge portion each comprise a plurality of slots.

3. The shelving assembly of claim 2, further comprising at least one divider, wherein said at least one divider comprises a pair of protrusions that are removably insertable into oppositely disposed slots, one from each of said first and second edges, and such that said divider is disposed substantially parallel to said securing members.

4. The shelving assembly of claim 3, wherein said at least one divider has ribs on a planar divider portion.

5. The shelving assembly of claim 3, wherein said at least one divider is adjustable by placement of said protrusions into corresponding slots of said first and second edge portion.

6. The shelving assembly of claim 1, wherein said base plate has a bottom side with one or more ribs for stability.

7. The shelving assembly of claim 1 wherein each said securing member includes at least one fastener, wherein said at least one fastener affixes each said securing member to receiving of said base plate.

8. The shelving assembly of claim 7, wherein said at least one fastener is at least one selected from the group consisting of: screws, pins, clips, adhesives, and rivets.

9. The shelving assembly of claim 1, wherein said arm portion further comprises a space creating a separated pair of perturbation portions.

10. The shelving assembly of claim 1, wherein said securing members allow insertion or removal of each of said plurality of rollers without disconnecting another of said plurality of rollers from said securing members.

11. The shelving assembly of claim 1, wherein said securing wherein each said securing member comprises a fill bar disposed between the first and second rows of arm portions.

12. The shelving assembly of claim 1, further comprising a plurality of said units attached in a parallel relationship to one another.

13. The shelving assembly of claim 12, wherein said plurality of said units are attached by a protruding connector on a first side edge of a first base plate and a receiving recess on a second side edge of a second base plate.

14. The shelving assembly of claim 2, further comprises a first channel member attached to said first edge portion of said base plate and a second channel member attached to said second edge portion of said base plate.

15. The shelving assembly of claim 14, wherein said first channel member has an inclined portion for stability and use for advertisement and/or pricing.

16. The shelving assembly of claim 14, wherein said first and second channel members further comprise a base channel, wherein said base plate is removably disposed within said base channel, and said base channel has a ridge to secure to a recess of said base plate.

17. The shelving assembly of claim 14, wherein said first and second channel members further comprise a retainer channel, and wherein a first retainer is removably disposed within said retainer channel of said first channel member substantially perpendicular to said securing members and a second retainer is removably disposed within said retainer channel of said second channel member substantially perpendicular to said securing members.

18. The shelving assembly of claim 17, wherein said first and second retainer have a clip corresponding with a ridge disposed within said retainer channel of said first and second channel members to form a snap fit.

19. The shelving assembly of claim 17, wherein said second retainer has a plurality of spaces to secure a weight-pusher assembly.

20. The shelving assembly of claim 19, wherein said weight-pusher assembly comprises a weight, a tether, and at least one hook, and wherein said tether connects said weight to said hook and said hook connects said tether to said spaces of said second retainer.

21. The shelving assembly of claim 19, wherein said weight-pusher assembly provides an appropriate amount of weight or pressure to an item on said shelving assembly to continuously maintain an item at the front of said shelving assembly.

22. The shelving assembly of claim 20, wherein the mass, height and width of said weight are adjustable.

23. The shelving assembly of claim 14, further comprising a pair of support panels disposed on opposite sides of said unit, wherein each said support panel includes a first tab and a second tab disposed about each end.

24. The shelving assembly of claim 23, wherein said first and second channel members further comprise a tab channel, and wherein said first and second tabs are removably disposed within said tab channels to attach to said support panel.

25. The shelving assembly of claim 23, wherein said support panels have one or more hooks to attach said unit to a tracks on a wall.

26. The shelving assembly of claim 23, further comprising at least one support beam under said base plate and attached to said support panels; said support beam being parallel to said first and second channel members.

27. The shelving assembly of claim 23, further comprising a front mount and a rear mount attached to said support panels, wherein said front mount has at least one front post positioned at an angle in relation to said front mount, and wherein said rear mount has at least one rear post positioned perpendicular to said rear mount.

28. The shelving assembly of claim 27, wherein said front post and said rear post lock said shelving assembly into holes on a deck or shelf.

29. The shelving assembly of claim 1, wherein said unit further comprises one or more legs attached to said base plate to set said unit on a deck or shelf.

30. The shelving assembly of claim 1, wherein said shelving assembly is at an angle between about 3 degrees to about 10 degrees.

31. The shelving assembly of claim 1, wherein said base plate has a roller storage area for spare rollers, and wherein said spare rollers are held within a storage bracket that is removably inserted into said roller storage area.

32. The shelving assembly of claim 1, wherein said base plate has a length of between about 2 inches to about 48 inches and a width between about 8 inches to about 36 inches.

* * * * *